US012173572B2

(12) United States Patent
Seren et al.

(10) Patent No.: US 12,173,572 B2
(45) Date of Patent: Dec. 24, 2024

(54) DISSOLVABLE BALLAST FOR UNTETHERED DOWNHOLE TOOLS

(71) Applicant: Saudi Arabian Oil Company, Dhahran (SA)

(72) Inventors: Huseyin Rahmi Seren, Houston, TX (US); Max Deffenbaugh, Fulshear, TX (US); Mohamed Larbi Zeghlache, Al Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 72 days.

(21) Appl. No.: 17/752,176

(22) Filed: May 24, 2022

(65) Prior Publication Data

US 2023/0383615 A1 Nov. 30, 2023

(51) Int. Cl.
*E21B 23/00* (2006.01)

(52) U.S. Cl.
CPC ..... *E21B 23/00* (2013.01); *E21B 2200/08* (2020.05)

(58) Field of Classification Search
CPC ..... E21B 23/00; E21B 2200/08
See application file for complete search history.

(56) References Cited

U.S. PATENT DOCUMENTS 5,878,813 A * 3/1999 Ridgeway, Jr. ..... E21B 49/081 166/162
7,168,494 B2 1/2007 Starr et al.
8,981,957 B2 3/2015 Gano et al.
10,301,910 B2 5/2019 Whitsitt et al.
10,337,279 B2 7/2019 Frazier
10,364,629 B2 7/2019 Jacob et al.
10,900,351 B2 1/2021 Deffenbaugh et al.
2002/0096322 A1* 7/2002 Barrett ..... E21B 17/0283 166/250.01
2004/0020643 A1* 2/2004 Thomeer ..... E21B 47/01 166/250.11

(Continued)

OTHER PUBLICATIONS bubbletightusa.com [online], "Innovative Materials," 2022, retrieved on Feb. 14, 2022, retrieved from URL <http://bubbletightusa.com/products/>, 9 pages.

(Continued)

*Primary Examiner* — Steven A Macdonald
(74) *Attorney, Agent, or Firm* — Osha Bergman Watanabe & Burton LLP

(57) ABSTRACT

An apparatus includes a ballast that is configured to couple to an untethered downhole tool. The ballast includes a composite material. The composite material includes a first portion and a second portion. The first portion includes metallic particles. The first portion is configured to, while the ballast is coupled to the untethered downhole tool, provide weight to the untethered downhole tool to lower the untethered downhole tool into a well formed in a subterranean formation. The second portion includes a polymer matrix. The metallic particles of the first portion are distributed throughout the polymer matrix of the second portion. The second portion is configured to dissolve in response to being exposed to downhole fluid within the well at specified downhole conditions, thereby releasing the metallic particles of the first portions from the polymer matrix that has dissolved.

19 Claims, 15 Drawing Sheets

(56) References Cited

U.S. PATENT DOCUMENTS

| | | | | |
|---|---|---|---|---|
| 2005/0241835 | A1* | 11/2005 | Burris, II | E21B 23/10 166/313 |
| 2007/0107908 | A1* | 5/2007 | Vaidya | C09K 8/80 166/376 |
| 2009/0254171 | A1 | 10/2009 | Heikkila | |
| 2010/0270031 | A1* | 10/2010 | Patel | E21B 33/1208 166/376 |
| 2014/0131045 | A1* | 5/2014 | Loiseau | E21B 43/119 166/241.1 |
| 2015/0167424 | A1* | 6/2015 | Richards | C09K 8/487 166/386 |
| 2017/0067328 | A1 | 3/2017 | Chauffe et al. | |
| 2017/0234103 | A1* | 8/2017 | Frazier | E21B 33/1291 166/138 |
| 2018/0087345 | A1* | 3/2018 | Xu | E21B 23/01 |
| 2018/0223624 | A1* | 8/2018 | Fripp | E21B 34/063 |
| 2018/0258757 | A1* | 9/2018 | Werry | E21B 43/267 |
| 2018/0363409 | A1 | 12/2018 | Frazier | |
| 2020/0032612 | A1* | 1/2020 | Joshi | E21B 43/38 |

OTHER PUBLICATIONS

Buzi et al. "Sensor Ball: An Autonomous Untethered Logging Platform," Offshore Technology Conference, May 2020, 10 pages.

Delmonte, "Molding and Casting of Metal/Polymer Composites," Metal/polymer composites, Springer, 1990, 37 pages.

Gahlin et al., "The particle size effect in abrasion studied by controlled abrasive surfaces," Wear, Jan. 1999, 224(1):118-125, 8 pages.

Polyakov et al., "Dependence of magnetic permeability of ferromagnetic powder materials on particle size," Powder Metallurgy and Metal Ceramics, 1995, 33: 9-10, 2 pages.

Seren et al. "Electro-permanent magnetic weight release mechanism for buoyancy control of an autonomous well-logging tool." AIP Advances, Feb. 2021, 11:025117, 8 pages.

tervesinc.com [online], "Dissolvables," 2017, retrieved on Feb. 14, 2022, retrieved from URL <https://www.tervesinc.com/products/dissolvables/>, 6 pages.

Zhao et al., "Advanced Compound Coating for Delaying Corrosion of Fast-Dissolving Alloy in High Temperature and Corrosive Environment", International Scholarly and Scientific Research & Innovation, 2021, 15(2):71-75, 5 pages.

* cited by examiner

DISSOLVABLE BALLAST FOR UNTETHERED DOWNHOLE TOOLS

TECHNICAL FIELD

This disclosure relates to downhole tools, and in particular, untethered downhole tools.

BACKGROUND

Hydrocarbon-containing wells are commonly logged using wireline tools or permanently installed sensors, such as optical fibers or electronic circuits that are wired to the surface. Wireline tools typically employ a large operating footprint, as they require the use of heavy equipment, such as blowout preventers, lubricators, winches, and cranes. Permanently installed sensors avoid such challenges. But, in some cases, it may not be economical to permanently install sensors in a well. Untethered downhole tools are an alternative that can be used in wells. Untethered tools can be lowered into a well, for example, by use of a motor or by passive means, which can include reliance on gravity, buoyancy, and flow of fluids.

SUMMARY

This disclosure describes technologies relating to dissolvable ballasts for untethered downhole tools. Certain aspects of the subject matter can be implemented as an apparatus. The apparatus includes a ballast that is configured to couple to an untethered downhole tool. The ballast includes a composite material. The composite material includes a first portion and a second portion. The first portion includes metallic particles. The first portion is configured to, while the ballast is coupled to the untethered downhole tool, provide weight to the untethered downhole tool to lower the untethered downhole tool into a well formed in a subterranean formation. The second portion includes a polymer matrix. The metallic particles of the first portion are distributed throughout the polymer matrix of the second portion. The second portion is configured to dissolve in response to being exposed to downhole fluid within the well at specified downhole conditions, thereby releasing the metallic particles of the first portions from the polymer matrix that has dissolved.

This, and other aspects, can include one or more of the following features. The composite material can have a density that is sufficient to cause the untethered downhole tool coupled to the ballast to continue to travel downhole in the well until the untethered downhole tool coupled to the ballast reaches a specified downhole location in the well. The polymer matrix of the second portion can be configured to begin dissolving in response to being exposed to downhole fluid within the well at a downhole temperature in a range of from about 4 degrees Celsius (° C.) to about 200° C. The polymer matrix of the second portion can be configured to begin dissolving in response to being exposed to downhole fluid within the well at a first dissolution rate sufficient for the ballast to provide weight to the untethered downhole tool as the untethered downhole tool travels downhole in the well toward the specified downhole location. The polymer matrix of the second portion can be configured to dissolve in response to being exposed to the downhole fluid within the well at a second dissolution rate sufficient for the polymer matrix of the second portion to fully dissolve at the specified downhole conditions once the untethered downhole tool has reached the specified downhole location in the well. The composite material can include about 70% to about 99% by weight of the first portion. The metallic particles can have an average particle diameter in a range of from about 10 micrometers (μm) to about 1 millimeter (mm). The metallic particles can include particles of at least one of tungsten, copper, iron, steel, nickel, cobalt, iron oxide, ferrite, silicon, tantalum, molybdenum, or lead. The polymer matrix can be water-dissolvable and can include at least one of polylactic acid (PLA), polyvinyl alcohol (PVA), polyglycolide (PGA), starch, cellulose, lipids, collagen, or chitin. The metallic particles can include ferromagnetic particles configured to provide soft magnetic properties to the ballast, and the ferromagnetic particles have a relative magnetic permeability greater than 10 and a non-zero magnetic coercivity that is less than 1 kiloamperes per meter (kA/m). The apparatus can include a magnetic actuator coupled to the untethered downhole tool. The magnetic actuator can include a first permanent magnet, a second permanent magnet, and a coil wrapped around the second permanent magnet. The coil can be configured to apply a first current in a first direction. The coil can be configured to apply a second current in a second direction opposite the first direction. While the coil applies the first current in the first direction, the first permanent magnet and the second permanent magnet can be configured to be magnetically polarized in the same direction, thereby generating an attractive force on the ferromagnetic particles of the first portion and coupling the ballast to the untethered downhole tool. While the coil applies the second current in the second direction, the first permanent magnet and the second permanent magnet can be configured to be magnetically polarized in opposite directions, thereby removing the attractive force on the ferromagnetic particles of the first portion and decoupling the ballast from the untethered downhole tool. The ballast can include a coating that covers at least a portion of an external surface of the composite material, thereby at least partially obstructing exposure of the polymer matrix of the second portion to downhole fluid and slowing down the dissolution of the polymer matrix of the second portion. The coating can have a thickness in a range of from about 1 micrometer (μm) to about 100 μm. The coating can include at least one of polytetrafluoroethylene (PTFE), parylene, diamond, silicon nitride, or silicon carbide.

Certain aspects of the subject matter can be implemented as a method. Metallic particles and a liquefied polymer are mixed to form a mixture. The mixture is placed within a mold. A magnet is placed in the vicinity of the mixture within the mold, thereby causing the metallic particles to position themselves in a self-assembly formation within the mixture in response to a magnetic field generated by the magnet. The liquefied polymer is solidified, such that a polymer matrix is formed. The metallic particles are distributed and secured in the self-assembly formation throughout the polymer matrix, thereby forming a ballast for an untethered downhole tool. The untethered downhole tool is configured to be lowered into a well formed in a subterranean formation. The polymer matrix is configured to dissolve in response to being exposed to downhole fluid within the well at specified downhole conditions.

This, and other aspects, can include one or more of the following features. A separator can be placed between the magnet and the mixture, such that the magnet does not come into physical contact with the mixture before solidifying the liquefied polymer. The metallic particles can include particles of at least one of tungsten, copper, iron, steel, nickel, cobalt, iron oxide, ferrite, silicon, tantalum, molybdenum, or lead. The metallic particles can include ferromagnetic particles configured to provide soft magnetic properties to the ballast, and the ferromagnetic particles have a relative magnetic permeability greater than 10 and a non-zero magnetic coercivity that is less than 1 kiloamperes per meter (kA/m). The polymer matrix can be water-dissolvable and comprises at least one of polylactic acid (PLA), polyvinyl alcohol (PVA), polyglycolide (PGA), starch, cellulose, lipids, collagen, or chitin. At least a portion of an external surface of the ballast can be coated with a coating having a thickness in a range of from about 1 micrometer (μm) to about 100 μm. The coating can include at least one of polytetrafluoroethylene (PTFE), parylene, diamond, silicon nitride, or silicon carbide.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes dissolvable ballasts for untethered downhole tools. The dissolvable ballasts described herein include a composite material. The composite material includes a first portion and a second portion. The first portion includes metallic particles which provide weight to the untethered downhole tool, so that the untethered downhole tool can be lowered into a well to a desired downhole location. The second portion includes a dissolvable polymer matrix. The polymer matrix dissolve upon exposure to downhole fluid at specified downhole conditions (temperature and pressure). In some cases, dissolution of the polymer matrix releases the ballast from the untethered downhole tool, for example, if the ballast is not released using a primary mechanism, such as an actuator.

The subject matter described in this disclosure can be implemented in particular implementations, so as to realize one or more of the following advantages. As the ballasts described herein are dissolvable, they do not accumulate and take up space within wells as conventional, non-dissolving ballasts do upon release. By nature of being dissolvable, the ballasts described herein provide a fail-safe mechanism on the off chance that the ballast-release function fails for any reason. The ballasts described herein can include ferromagnetic material that can be attracted to magnetic actuators without the use of a steel attachment plate, which is typically necessary for conventional ballasts made from aluminum or magnesium alloys. The ballasts described herein can include denser material in comparison to conventional ballasts, thereby reducing volume requirements.

Figure 1:
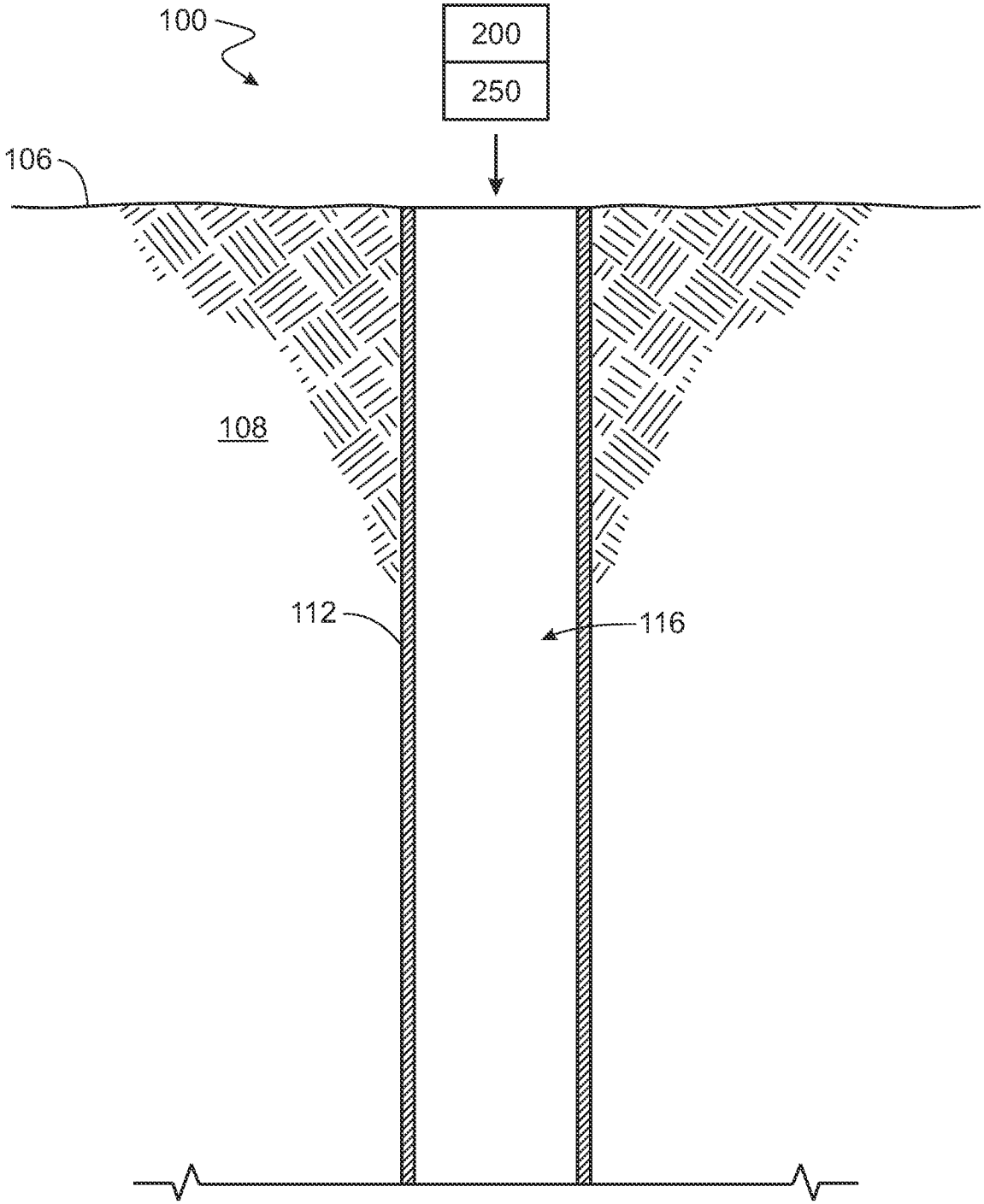
FIG. 1 is a schematic diagram of an example well.

FIG. 1 depicts an example well 100 constructed in accordance with the concepts herein. The well 100 extends from the surface 106 through the Earth 108 to one more subterranean zones of interest (one shown). The well 100 enables access to the subterranean zones of interest to allow recovery (that is, production) of fluids to the surface 106 (represented by flow arrows in FIG. 1) and, in some implementations, additionally or alternatively allows fluids to be placed in the Earth 108. In some implementations, the subterranean zone is a formation within the Earth 108 defining a reservoir, but in other instances, the zone can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly) end-to-end. In FIG. 1, the casing 112 is perforated in the subterranean zone of interest to allow fluid communication between the subterranean zone of interest and the bore 116 of the casing 112. In some implementations, the casing 112 is omitted or ceases in the region of the subterranean zone of interest. This portion of the well 100 without casing is often referred to as "open hole."

In particular, casing 112 is commercially produced in a number of common sizes specified by the American Petroleum Institute (the "API"), including 4½, 5, 5½, 6, 6⅝, 7, 7⅝, 7¾, 8⅝, 8¾, 9⅝, 9¾, 9⅞, 10¾, 11¾, 11⅞, 13⅜, 13½, 13⅝, 16, 18⅝, and 20 inches, and the API specifies internal diameters for each casing size. The system 150 can be configured to fit in, and (as discussed in more detail below) in certain instances, seal to the inner diameter of one of the specified API casing sizes. Of course, the system 150 can be made to fit in and, in certain instances, seal to other sizes of casing or tubing or otherwise seal to a wall of the well 100.

An untethered downhole tool 250 can be lowered into the well 100 using a dissolvable ballast 200. The untethered downhole tool 250 is a downhole tool (for example, a logging tool, a semi-permanent monitoring tool, an imaging tool, a seismic source/receiver tool, or a chemical delivery vessel) that is untethered and can be lowered into the well 100 independent of a deployment system, such as jointed tubing (that is, lengths of tubing joined end-to-end), a sucker rod, a coiled tubing (that is, not-jointed tubing, but rather a continuous, unbroken and flexible tubing formed as a single piece of material), or cable (such as a slickline or a monofilament or multifilament wire rope with one or more electrical conductors, sometimes called an e-line). The ballast 200 can be coupled to the untethered downhole tool 250 to provide weight to the tool 250, such that the untethered downhole tool 250 can sink to a desired downhole location in the well 100. The ballast 200 is released once the downhole tool 250 has reached the desired downhole location in the well 100. The ballast 200 is dissolvable, such that it dissolves and does not need to be retrieved from the well 100 after the ballast 200 has performed its weighting function for the downhole tool 250. In some implementations, the untethered downhole tool 250 includes a magnetic actuator (not shown in FIG. 1, but an example is shown in FIG. 2F and described in more detail later) which can be used to release the ballast 200 at a target depth within the well 100 and change the trajectory of the downhole tool 250 to perform a function within the well 100, such as measuring temperature, measuring pressure, determining depth, determining perforation location, measuring fluid flow/production rate, determining fluid phase, determining fluid composition, measuring a fluid physical property (for example, density, viscosity, or conductivity), or measuring a casing physical property (for example, conductivity, thickness, or size of defect).

Figure 2A:
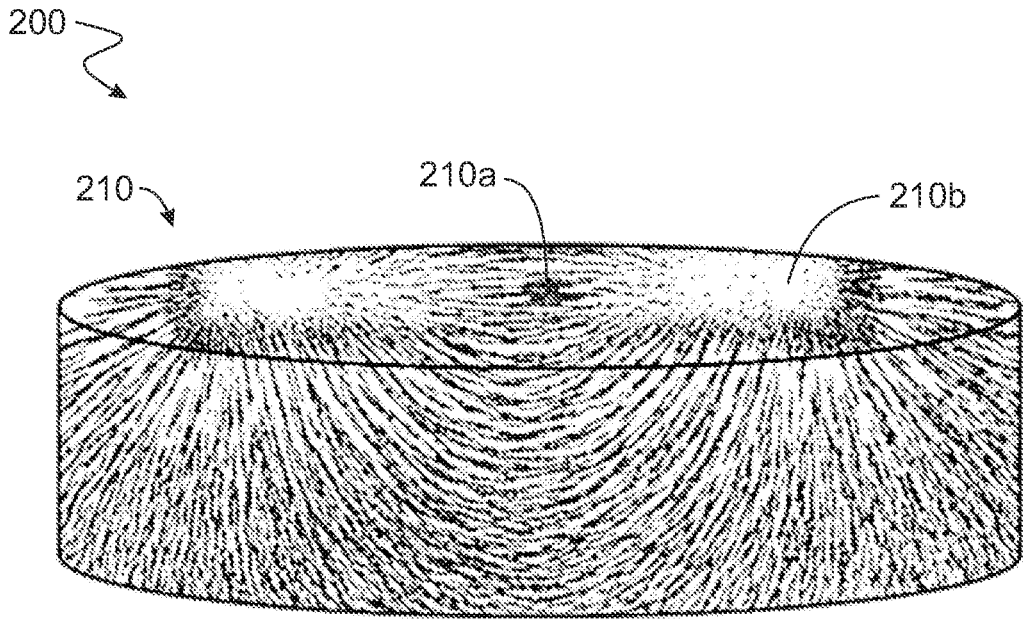
FIG. 2A is a schematic diagram of an example ballast for lowering an untethered downhole tool into a well.

FIG. 2A depicts an example dissolvable ballast 200. The ballast 200 is configured to couple to an untethered downhole tool (such as the downhole tool 250). For example, the ballast 200 can be adhesively or threadedly coupled to (such as screwed onto) the body of the untethered downhole tool 250. In such cases, the trajectory of the untethered downhole tool 250 traveling within the well 100 is adjusted only based on dissolution of the ballast 200. In cases where increased control of the trajectory of the untethered downhole tool 250 traveling within the well 100 is preferred, the ballast 200 can be coupled to the body of the untethered downhole tool 250 via an actuator, which can be controlled, for example, by a microcontroller and an electrical circuit. An example of an actuator is shown in FIG. 2F and is described in more detail later.

The ballast 200 includes a composite material 210. The composite material 210 includes a first portion 210*a* and a second portion 210*b*. The first portion 210*a* includes metallic particles. The first portion 210*a* is configured to, while the ballast 200 is coupled to the untethered downhole tool 250, provide weight to the untethered downhole tool 250 to lower the untethered downhole tool 250 into a well formed in a subterranean formation (such as the well 100). Thus, the ballast 200 can be coupled to the untethered downhole tool 250 and placed into the well 100, and the weight of the ballast 200 can be used to lower the untethered downhole tool 250 to a specified downhole location in the well 100. The second portion 210*b* includes a polymer matrix. The metallic particles of the first portion 210*a* are distributed throughout the polymer matrix of the second portion 210*b*. The second portion 210*b* is configured to dissolve in response to being exposed to downhole fluid within the well 100 at specified downhole conditions. In some implementations, the second portion 210*b* (polymer matrix) is configured to dissolve in response to being exposed to downhole fluids that include water (for example, connate water or formation water that can include dissolved solids, such as potassium chloride) at specified downhole conditions. When the polymer matrix of the second portion 210*b* dissolves, the ballast 200 releases the metallic particles of the first portion 210*a*. The metallic particles of the first portion 210*a* can disperse into the downhole fluid in the well 100. In some cases, after the polymer matrix of the second portion 210*b* has dissolved, the metallic particles of the first portion 210*a* can be produced with the downhole fluid from the well 100 to remove the metallic particles of the first portion 210*a* from the well 100. In some cases, after the untethered downhole tool 250 has reached the specified downhole location in the well 100, the untethered downhole tool 250 is secured at the specified downhole location in the well 100, such that the untethered downhole tool 250 remains at the specified downhole location in the well 100 even after the ballast 200 has been released from the untethered downhole tool 250. In some cases, once the untethered downhole tool 250 has reached the specified downhole location in the well 100 the untethered downhole tool 250 is released from the ballast 200 (unweighted) and floats back to the surface. Such configurations may be useful, for example, in cases where the untethered downhole tool 250 includes logging tools that take measurements as the untethered downhole tool 250 travels downhole into the well 100 and then the measurements are retrieved from the untethered downhole tool 250 once the untethered downhole tool 250 has returned to the surface. In some cases, the untethered downhole tool 250 sinks to the bottom of the well 100, either by design or due to a failure, for example, of the actuator. The ballast 200 dissolves while being exposed to wellbore fluids at downhole conditions, and as the ballast 200 dissolves, the untethered downhole tool 250 regains buoyancy (by way of the ballast 200 losing its weighting function via dissolution) and begins to travel uphole back to the surface 106. Depending on factors such as downhole conditions, design of the untethered downhole tool 250, and/or design of the ballast 200, at least a portion of the ballast 200 may also reach the surface 106 along with the untethered downhole tool 250 or the entire ballast 200 may have dissolved by the time the untethered downhole tool 250 has reached the surface 106.

In some implementations, the untethered downhole tool 250 includes a permanent magnet that holds and couples the ballast 200 to the untethered downhole tool 250, as opposed to an actuator (example shown in FIG. 2F and described in more detail later) that holds and couples the ballast 200 to the untethered downhole tool 250. In such implementations, the trajectory of the untethered downhole tool 250 depends on the dissolution of the polymer matrix of the second portion 210*b*. In such implementations, the permanent magnet can be disposed in a recess of the body of the untethered downhole tool 250, such that after the second portion 210*b* of the ballast 200 dissolves, the permanent magnet of the untethered downhole tool 250 does not become attached to other magnetic surfaces within the well 100 (for example, casing, tubing, or wellhead).

The composite material 210 of the ballast 200 has a density that is sufficient to cause the untethered downhole tool 250 (coupled to the ballast 200) to continue to travel downhole in the well 100 while the untethered downhole tool 250 is coupled to the ballast 200 and reaches the specified downhole location. In some implementations, the specified downhole location has a measured depth (that is, the measured length along a path of the wellbore) in a range of from about 0 feet (that is, at the surface 106) to about 15,000 feet. In some implementations, the specified downhole location has a true vertical depth (that is, the vertical depth independent of the path of the wellbore) in a range of from about 0 feet to about 10,000 feet. The composite material 210 of the ballast 200 can have an overall density that is greater than the density of typical materials that make up conventional ballasts, such as aluminum (about 2.7 g/cm$^3$) and magnesium (about 1.75 g/cm$^3$).

The weight ratio of the first portion 210*a* to the second portion 210*b* in the composite material 210 can be adjusted based on desired properties of the ballast 200. For example, the weight ratio of the first portion 210*a* to the second portion 210*b* in the composite material 210 can be 1:1 or greater. In some implementations, it can be desirable for the composite material 210 to include more of the first portion 210*a* (metallic particles) by weight in comparison to the second portion 210*b* (polymer matrix), such that the composite material 210 exhibits properties that are more similar to the metallic particles (for example, density and magnetic permeability). In some implementations, the composite material 210 includes about 50 weight percent (wt. %) to about 99 wt. % of the first portion 210*a* (that is, the first portion makes up about 50% to about 99% by weight of the composite material 210). For example, the composite material 210 can include from about 60 wt. % to about 99 wt. %, from about 70 wt. % to about 99 wt. %, from about 80 wt. % to about 99 wt. %, from about 90 wt. % to about 99 wt. %, from about 50 wt. % to about 90 wt. %, from about 60 wt. % to about 90 wt. %, from about 70 wt. % to about 90 wt. %, from about 80 wt. % to about 90 wt. %, from about 50 wt. % to about 80 wt. %, from about 60 wt. % to about 80 wt. %, from about 70 wt. % to about 80 wt. %, from about 50 wt. % to about 70 wt. %, from about 60 wt. % to about 70 wt. %, or from about 50 wt. % to about 60 wt. %.

The metallic particles of the first portion 210*a* can include soft ferromagnetic particles that are configured to provide soft magnetic properties to the ballast 200. Soft ferromagnetic particles generally have large relative magnetic permeability (for example, greater than 10) a low magnetic coercivity that is non-zero and less than 1 kiloamperes per meter (kA/m). Magnetic coercivity of a material is a measure of the ability of the ferromagnetic material to withstand an external magnetic field without becoming magnetized or demagnetized. Materials with soft magnetic properties can become magnetized easily when exposed to a magnetic field, which in turn results in a strong attraction between the magnetic field and the soft magnetic material. When the soft magnetic material is removed from exposure of the magnetic field (that is, the external magnetic field is stopped or removed), the soft magnetic material loses its residual magnetic field and thus also loses their attraction toward other soft magnetic materials. Some examples of soft magnetic materials include iron, certain oxides of iron, soft ferrite ceramics, carbon steels, soft nickel-iron alloys, iron-silicon alloys, amorphous alloys, and nano-crystalline alloys. Most of these examples of soft magnetic materials are commonly used to make inductor cores. The metallic particles of the first portion 210*a* can include particles of soft magnetic material(s) as well as high density material(s), such as tungsten, tantalum, molybdenum, copper, steel, nickel, cobalt, lead, compound(s) including any of these, oxide(s) including any of these, alloy(s) including any of these, or any combination of these. Smaller metallic particles have a reduced risk to precipitate in comparison to larger metallic particles. Thus, smaller metallic particles may more easily be transported to the surface with downhole fluids and may cause less cluttering inside the well 100 in comparison to larger metallic particles. In some cases, the metallic particles of the first portion 210*a* have an average particle diameter or a maximum dimension of less than about 100 micrometers (μm). Larger soft magnetic particles can have a stronger magnetic attraction force to an external magnetic field in comparison to smaller metallic particles. Smaller soft magnetic particles may more easily saturate in an external magnetic field in comparison to larger soft magnetic particles. In some cases, the metallic particles of the first portion 210*a* have an average particle diameter or a minimum dimension of greater than about 50 μm.

In some implementations, the metallic particles of the first portion 210*a* have an average particle diameter in a range of from about 10 μm to about 1 centimeter (cm). For example, the metallic particles of the first portion 210*a* can have an average particle diameter in a range of from about 1 μm to about 5 millimeters (mm), from about 1 μm to about 1 mm, from about 1 μm to about 500 μm, from about 1 μm to about 400 μm, from about 1 μm to about 300 μm, from about 1 μm to about 200 μm, from about 1 μm to about 100 μm, from about 1 μm to about 50 μm, from about 1 μm to about 40 μm, from about 1 μm to about 30 μm, from about 1 μm to about 20 μm, from about 1 μm to about 10 μm, from about 1 μm to about 5 μm, from about 10 μm to about 500 μm, from about 10 μm to about 250 μm, from about 10 μm to about 100 μm, from about 25 μm to about 250 μm, or from about 50 μm to about 100 μm. For example, the metallic particles of the first portion 210*a* can have an average particle diameter of about 1 μm, about 3 μm, about 5 μm, about 10 μm, about 30 μm, about 50 μm, about 100 μm, about 300 μm, about 500 μm, about 1 mm, about 5 mm, or about 1 cm. For carrying out the weighting function of the ballast 200, the metallic particles of the first portion 210*a* have a density that is not less than about 7 grams per cubic centimeter (g/cm$^3$). For example, the metallic particles of the first portion 210*a* can have a density in a range of from about 7 g/cm$^3$ to about 20 g/cm$^3$.

The polymer matrix of the second portion 210*b* is made of a dissolvable polymer, which can be advantageous over metallic dissolvable materials. For example, polymers may dissolve based on hydrolysis, which can be exothermic or endothermic, depending on the operating temperature. For example, polymers may fully dissolve in response to exposure to downhole fluid at the specified downhole conditions without creating aggregating byproducts, which can interfere with downhole operations and/or damage the downhole tool 250. For example, polymers may fully dissolve in response to exposure to downhole fluid at the specified downhole conditions without forming a passivation layer. A passivation layer is a layer of byproduct(s) that may cover an outer surface of a reactant substrate (such as an aluminum-based or magnesium-based ballast), which can prevent and/or slow down the reaction of inner layers by blocking exposure to wellbore fluids (for example, including water). Formation of a passivation layer can in some implementations be disadvantageous, as the formation of the passivation layer may hinder and/or stop the dissolution process of the ballast (for example, by significantly reducing the dissolution speed of the ballast). For example, polymers may fully dissolve in response to exposure to downhole fluid at the specified downhole conditions without forming a passivation layer and/or a mud-like aggregate (which can form, for example, by dissolution of an aluminum-based alloy), which can interfere with downhole operations and/or cause undesired sticking of the downhole tool 250 in the well 100.

The polymer matrix of the second portion 210*b* can dissolve in response to being exposed to fluids that include water or to fluids that include organic species. The polymer matrix of the second portion 210*b* can include polylactic acid (PLA), polyvinyl alcohol (PVA), polyglycolide (PGA), starch, cellulose, lipids, collagen, chitin, or any combination of these. PVA is a synthetic biodegradable polymer with a density of about 1.2 g/cm$^3$ and adhesive properties. PGA is a material used sometimes to produce frac balls, which can be implemented in fracking operations. As one example, dissolution of PVA is exothermic for temperatures less than 55 degrees Celsius (° C.) and endothermic for temperatures greater than 55° C. It can be typical for downhole conditions to be greater than 55° C., so the endothermic dissolution of PVA can be beneficial by mitigating or eliminating the risk of overheating of the downhole tool 250, which could damage the tool 250.

In some implementations, the polymer matrix of the second portion 210*b* is configured to dissolve in response to exposure to downhole fluid in the well 100 at a downhole temperature in a range of from about 4° C. to about 200° C. For example, the specified downhole conditions at which the polymer matrix of the second portion 210*b* is configured to dissolve (along with exposure to the downhole fluid) includes a downhole temperature in a range of from about 10° C. to about 200° C., from about 20° C. to about 200° C., from about 30° C. to about 200° C., from about 40° C. to about 200° C., from about 50° C. to about 200° C., from about 60° C. to about 200° C., from about 70° C. to about 200° C., from about 80° C. to about 200° C., from about 90° C. to about 200° C., from about 100° C. to about 200° C., from about 110° C. to about 200° C., from about 120° C. to about 200° C., from about 130° C. to about 200° C., from about 140° C. to about 200° C., from about 150° C., to about 200° C., from about 160° C. to about 200° C., from about 170° C. to about 200° C., from about 180° C. to about 200° C., from about 190° C. to about 200° C., from about 50° C. to about 175° C., from about 75° C. to about 175° C., from about 100° C. to about 175° C., from about 125° C. to about 175° C., from about 150° C. to about 175° C., from about 50° C. to about 150° C., from about 75° C. to about 150° C., from about 100° C. to about 150° C., from about 125° C. to about 150° C., from about 50° C. to about 125° C., from about 75° C. to about 125° C., from about 100° C. to about 125° C., from about 50° C. to about 100° C., from about 75° C. to about 100° C., or from about 50° C. to about 75° C.

In some implementations, the polymer matrix of the second portion 210*b* is configured to dissolve in response to exposure to downhole fluid in the well 100 at a downhole pressure in a range of from about 15 pounds per square inch gauge (psig) to about 10,000 psig. For example, the specified downhole conditions at which the polymer matrix of the second portion 210*b* is configured to dissolve (along with exposure to the downhole fluid) includes a downhole pressure in a range of from about 50 psig to about 10,000 psig, from about 100 psig to about 10,000 psig, from about 250 psig to about 10,000 psig, from about 500 psig to about 10,000 psig, from about 750 psig to about 10,000 psig, from about 1,000 psig to about 10,000 psig, from about 2,500 psig to about 10,000 psig, from about 5,000 psig to about 10,000 psig, or from about 7,500 psig to about 10,000 psig.

The polymer matrix of the second portion 210*b* is configured to dissolve in response to exposure to downhole fluid in the well 100 in a manner, such that the polymer matrix of the second portion 210*b* dissolves at a first dissolution rate sufficient for the ballast 200 to perform its weighting function for the untethered downhole tool 250 as the untethered downhole tool 250 travels downhole in the well 100 toward the specified downhole location, and the polymer matrix of the second portion 210*b* dissolves at a second dissolution rate sufficient for the polymer matrix of the second portion 210*b* to fully dissolve at the specified downhole conditions once the downhole tool 250 has reached the specified downhole location in the well 100. The first dissolution rate can be slower than the second dissolution rate. In some implementations, the polymer matrix of the second portion 210*b* is configured to dissolve in response to exposure to downhole fluid in the well 100 at the specified downhole conditions at a rate in a range of from about 0.1 milligrams per minute (mg/min) to about 100 mg/min. The rate at which the polymer matrix of the second portion 210*b* dissolves in response to exposure to downhole fluid in the well 100 at the specified downhole conditions can be determined by various factors, such as shape of the composite material 210, distribution of the metallic particles of the first portion 210*a* throughout the polymer matrix of the second portion 210*b*, and exposure of an outer surface of the polymer matrix to the downhole fluid as the ballast 200 coupled to the downhole tool 250 travels downhole into the well 100. In some implementations, the first dissolution rate at which the polymer matrix of the second portion 210*b* dissolves as the untethered downhole tool 250 (coupled to the ballast 200) travels downhole in the well 100 toward the specified downhole location is in a range of from about 0.1 mg/min to about 100 mg/min. In some implementations, the second dissolution rate at which the polymer matrix of the second portion 210*b* dissolves at the specified downhole conditions once the downhole tool 250 has reached the specified downhole location in the well 100 is in a range of from about 50 mg/min to about 500 mg/min.

In some implementations, the polymer matrix of the second portion 210*b* is configured to maintain a substantial portion of its integrity (to provide its weighting function to the untethered downhole tool 250) for at least 6 hours, at least 7 hours, at least 8 hours, at least 9 hours, at least 10 hours, at least 11 hours, at least 12 hours, at least 13 hours, at least 14 hours, at least 15 hours, at least 16 hours, at least 17 hours, at least 18 hours, at least 19 hours, at least 20 hours, at least 21 hours, at least 22 hours, at least 23 hours, or at least 24 hours upon exposure to downhole fluids within the well 100. For example, the polymer matrix of the second portion 210*b* is configured to retain at least 80% of its weight (that is, have less than 20 wt. % of the polymer matrix of the second portion 210*b* dissolved) in response to exposure to downhole fluids within the well 100 for at least 16 hours, such that the untethered downhole tool 250 has sufficient time to reach the desired location within the well 100.

In some implementations, the polymer matrix of the second portion 210*b* includes a hydrolysis inhibitor. Hydrolysis inhibitors are sacrificial chemicals that delay the onset of weight loss of a polymer, such as PLA. Some examples of hydrolysis inhibitors include carbodiimides and polycarbodiimides. A hydrolysis inhibitor reacts with the acid that is generated during PLA hydrolysis and therefore reduces the auto-acceleration of PLA hydrolysis and premature weight loss of the polymer. Once the hydrolysis inhibitors are consumed, PLA hydrolysis may accelerate and significant weight loss of the polymer may occur.

Figure 2B:
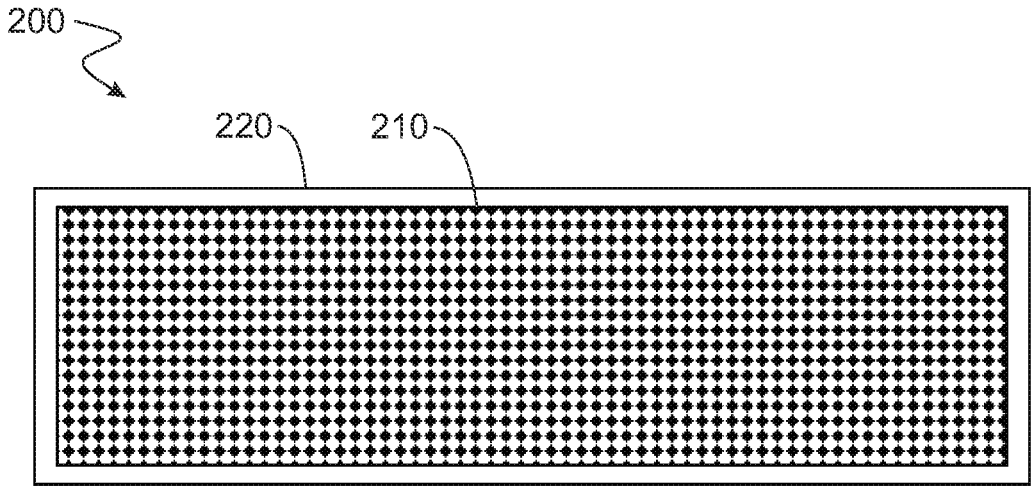
FIG. 2B is a cross-sectional schematic diagram of an example ballast for lowering an untethered downhole tool into a well.

FIG. 2B shows a cross-section of an implementation of the ballast 200 that includes a coating 220. As shown in FIG. 2B, the ballast 200 can include a coating 220 that covers at least a portion of an external surface of the composite material 210. The coating 220 can at least partially obstruct exposure of the polymer matrix of the second portion 210*b* to downhole fluid in the well 100, which can slow down the dissolution of the polymer matrix of the second portion 210*b*. The delay of the dissolution of the polymer matrix of the second portion 210*b* by the coating 220 can be adjusted by adjusting parameters of the coating 220, such as thickness and coverage of the external surface of the composite material 210 by the coating 220. In some implementations, the coating 220 has a thickness in a range of from about 1 μm to about 100 μm. For example, the coating 220 can have a thickness in a range of from about 5 μm to about 100 μm, from about 10 μm to about 100 μm, from about 20 μm to about 100 μm, from about 30 μm to about 100 μm, from about 40 μm to about 100 μm, from about 50 μm to about 100 μm, from about 60 μm to about 100 μm, from about 70 μm to about 100 μm, from about 80 μm to about 100 μm, from about 90 μm to about 100 μm, from about 1 μm to about 90 μm, from about 1 μm to about 80 μm, from about 1 μm to about 70 μm, from about 1 μm to about 60 μm, from about 1 μm to about 50 μm, from about 1 μm to about 40 μm, from about 1 μm to about 30 μm, from about 1 μm to about 20 μm, from about 1 μm to about 10 μm, or from about 1 μm to about 5 μm.

The coating 220 can cover from about 1% to about 99% of the external surface of the composite material 210. For example, the coating 220 can cover from about 1% to about 90%, from about 1% to about 80%, from about 1% to about 70%, from about 1% to about 60%, from about 1% to about 50%, from about 1% to about 40%, from about 1% to about 30%, from about 1% to about 20%, from about 1% to about 10%, from about 10% to about 99%, from about 20% to about 99%, from about 30% to about 99%, from about 40% to about 99%, from about 50% to about 99%, from about 60% to about 99%, from about 70% to about 99%, from about 80% to about 99%, or from about 90% to about 99% of the external surface of the composite material 210. In some implementations, the coating 220 has a pattern that defines apertures that allow for exposure of the polymer matrix of the second portion 210*b* to downhole fluid in the well 100. In some implementations, the apertures defined by the pattern of the coating 220 are large enough to allow the metallic particles of the first portion 210*a* to pass through once the polymer matrix of the second portion 210*b* has dissolved and released the metallic particles of the first portion 210*a*.

In some implementations, the coating 220 is made of a material that does not dissolve in and/or react with downhole fluid in the well 100. For example, the coating 220 is made of polytetrafluoroethylene (PTFE), parylene, diamond, silicon nitride, silicon carbide, or any combination of these. In some implementations, the coating 220 is configured to dissolve more slowly in comparison to the polymer matrix of the second portion 210*b* in response to being exposed to downhole fluid in the well 100. In such implementations, the coating 220 slows down dissolution of the polymer matrix of the second portion 210*b* but also fully dissolves after sufficient exposure to downhole fluid in the well 100, such that the coating 220 does not need to be physically retrieved from the well 100 after the untethered downhole tool 250 has reached the specified downhole location in the well 100.

Figure 2C:
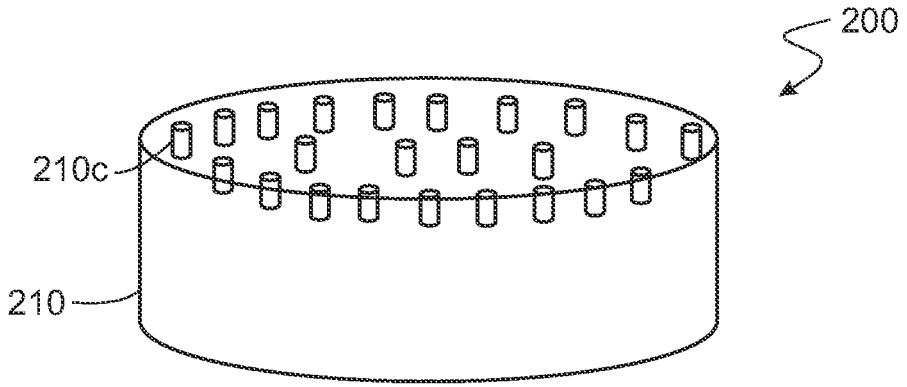
FIG. 2C is a schematic diagram of an example ballast that includes soft magnetic inserts.

FIG. 2C is a schematic diagram of an example ballast 200 that includes soft magnetic inserts 210*c*. In some implementations, the soft magnetic inserts 210*c* can have properties that are the same as or similar to those of the metallic particles of the first portion 210*a*. In some implementations, the metallic particles of the first portion 210*a* primarily provide the weighting function of the ballast 200, while the soft magnetic inserts 210*c* primarily provide the soft magnetic properties of the ballast 200. In some implementations, the metallic particles of the first portion 210*a* and the soft magnetic inserts 210*c* provide both the weighting function and the soft magnetic properties of the ballast 200.

In some implementations, the composite material 210 fully encapsulates one or more of the soft magnetic inserts 210*c*. In some implementations, at least a portion of each of the soft magnetic inserts 210*c* is not covered by the composite material 210. For example, at least one surface of each of the soft magnetic inserts 210*c* is exposed. Such configurations may allow for easier and/or better coupling to the actuator 260 (an example shown in FIG. 2F). The soft magnetic inserts 210*c* and the metallic particles of the first portion 210*a* can be released from the ballast 200 in response to the polymer matrix of the second portion 210*b* dissolving. In some implementations, the soft magnetic inserts 210*c* are made of a material that corrodes quickly in response to being exposed to downhole fluids at downhole conditions. For example, the soft magnetic inserts 210*c* can be configured to corrode and/or dissolve in response to being exposed to downhole fluids at downhole conditions within a span of a day or a few days.

Figure 2D:
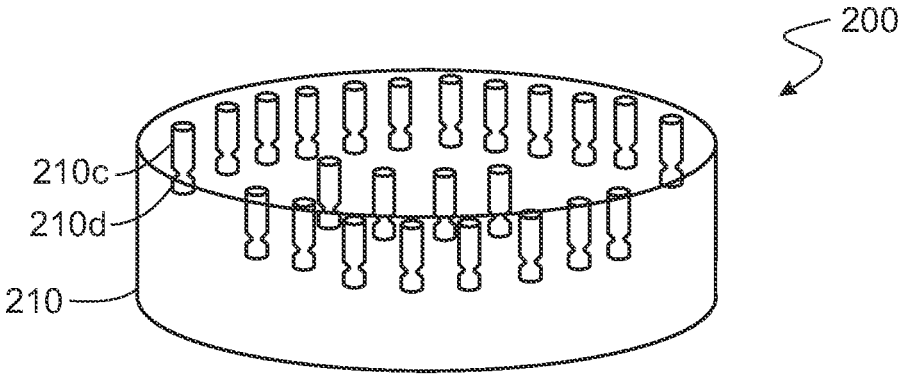
FIG. 2D is a schematic diagram of an example ballast that includes soft magnetic inserts with mechanical locks.

FIG. 2D is a schematic diagram of an example ballast 200 that includes soft magnetic inserts 210*c* with mechanical locks 210*d*. For example, each of the soft magnetic inserts 210*c* includes its own mechanical lock 210*d*. In some implementations, the mechanical locks 210*d* are configured to improve coupling (for example, adhesion) between the soft magnetic inserts 210*c* and the composite material 210 (for example, the polymer matrix of the second portion 210*b*). In some implementations, the mechanicals locks

210*d* are configured to improve coupling (for example, adhesion and/or magnetic attraction) between the soft magnetic inserts 210*c* and the actuator 260 (an example shown in FIG. 2F).

Figure 2E:
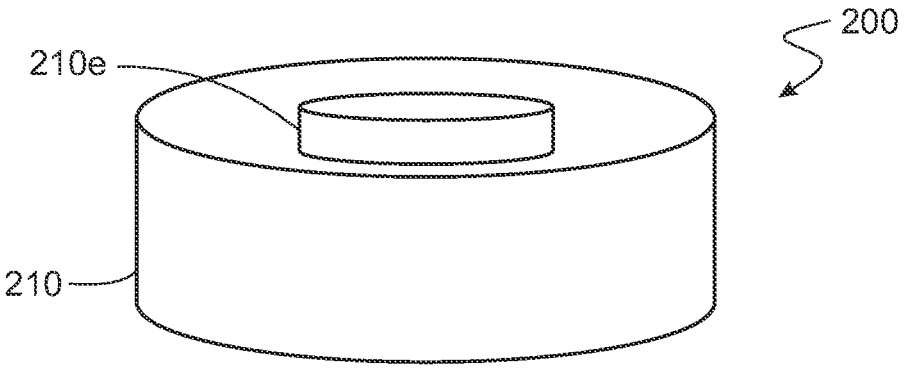
FIG. 2E is a schematic diagram of an example ballast that includes a soft magnetic attachment plate.
Figure 2F:
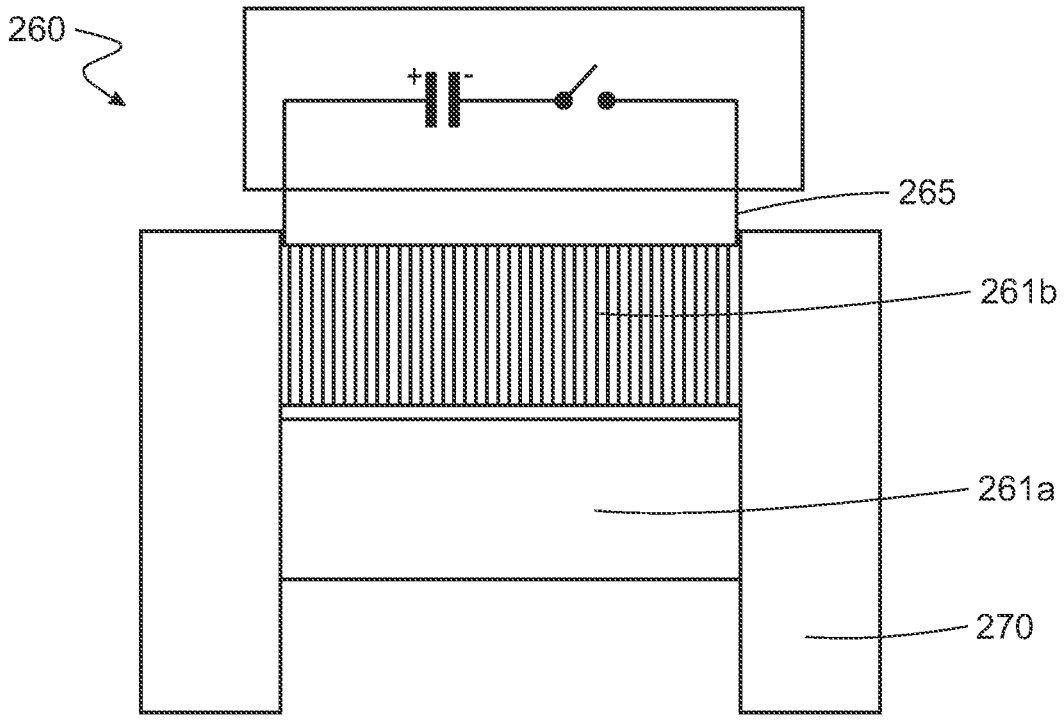
FIG. 2F is a schematic diagram of an example actuator that can couple a ballast to an untethered downhole tool.

FIG. 2E is a schematic diagram of an example ballast that includes a soft magnetic attachment plate 210*e*. The attachment plate 210*e* can have properties that are the same as or similar to those of the soft magnetic inserts 210*c* and/or the metallic particles of the first portion 210*a*. In some implementations, the metallic particles of the first portion 210*a* primarily provide the weighting function of the ballast 200, while the attachment plate 210*e* primarily provides the soft magnetic properties of the ballast 200. In some implementations, the metallic particles of the first portion 210*a* and the attachment plate 210*e* provide both the weighting function and the soft magnetic properties of the ballast 200.

In some implementations, at least a portion of the attachment plate 210*e* is not covered by the composite material 210. For example, at least one surface of the attachment plate 210*e* is exposed. The exposed surface of the attachment plate 210*e* may allow for easier and/or better coupling to the actuator 260 (an example shown in FIG. 2F). The attachment plate 210*e* and the metallic particles of the first portion 210*a* can be released from the ballast 200 in response to the polymer matrix of the second portion 210*b* dissolving. In some implementations, the attachment plate 210*e* is made of a material that corrodes quickly in response to being exposed to downhole fluids at downhole conditions. For example, the attachment plate 210*e* can be configured to corrode and/or dissolve in response to being exposed to downhole fluids at downhole conditions within a span of a day or a few days.

FIG. 2F depicts an example actuator 260 which can couple the ballast 200 to the untethered downhole tool 250. The actuator 260 can be, for example, a magnetic actuator, a solenoid actuator, a pyrotechnic fastener, a thermal actuator, or an electric motor. The example actuator 260 shown in FIG. 2F is a magnetic actuator. In cases where the actuator 260 is a magnetic actuator, the ballast 200 needs to include a magnetic material (for example, ferromagnetic and/or have soft magnetic properties). For example, the metallic particles 320 of the ballast 200 are magnetic and/or the ballast 200 can include an attachment plate that is magnetic (such as the attachment plate 210*e* shown in FIG. 2E). The attachment plate 210*e* can, for example, be adhesively or threadedly coupled to the ballast 200. In some cases, curing of the polymer matrix of the second portion 210*b* while the attachment plate 210*e* is in contact with the second portion 210*b* can cause the attachment plate 210*e* to be coupled to the ballast 200. In some cases, an over-molding process can be implemented to mold the composite material 210 around the attachment plate 210*e* while leaving the contact surface of the attachment plate 210*e* uncovered (as shown in FIG. 2E). The actuator 260 can be magnetized to create a pull force on the ballast 200 and/or the attachment plate 210*e* coupled to the ballast 200 to hold and couple the ballast 200 to the body of the untethered downhole tool 250. Once the untethered downhole tool 250 has reached a desired location within the well 100, the actuator 260 can be demagnetized or the pull force of the actuator 260 can be decreased (for example, by the microcontroller) to release the ballast 200 from the untethered downhole tool 250. Releasing the ballast 200 from the untethered downhole tool 250 removes the weighting function of the ballast 200 from the untethered downhole tool 250, effectively increasing the buoyancy of the untethered downhole tool 250, such that the trajectory of the untethered downhole tool 250 within the well 100 changes (for example, in an uphole direction).

The actuator 260 shown in FIG. 2F is an electro-permanent magnet-based actuator. The actuator 260 includes a first permanent magnet 261*a* and a second permanent magnet 261*b*. The first permanent magnet 261*a* is made of a material that has a greater coercivity (that is, resistance to having its magnetization direction reversed) in comparison to the second permanent magnet 261*b*. The second permanent magnet 261*b* is made of a material that has a lesser coercivity in comparison to the first permanent magnet 261*a* and therefore can have its polarization changed more easily. In some implementations, the first permanent magnet 261*a* is made of samarium-cobalt (SmCo) or neodymium-iron-boron (also known as NIB or NdFeB). In some implementations, the second permanent magnet 261*b* is made of Alnico V. The sizes and materials of the permanent magnets 261*a*, 261*b* can be selected, such that they have substantially the same magnetic strength (that is, remnant magnetization). A coil 265 is wrapped around the second permanent magnet 261*b*. In some implementations, the coil 265 is wrapped around both permanent magnets 261*a*, 261*b*. In some implementations, the actuator 260 includes an even number of more than two permanent magnets (for example, four, six, or eight), all of which are made of the same material (for example, Alnico V) and have the same dimensions (size). In such implementations, the coil 265 is wrapped around half of the permanent magnets, such that only half of the magnets wrapped by the coil 265 can have their polarization adjusted by the coil 265.

Figure 2G:
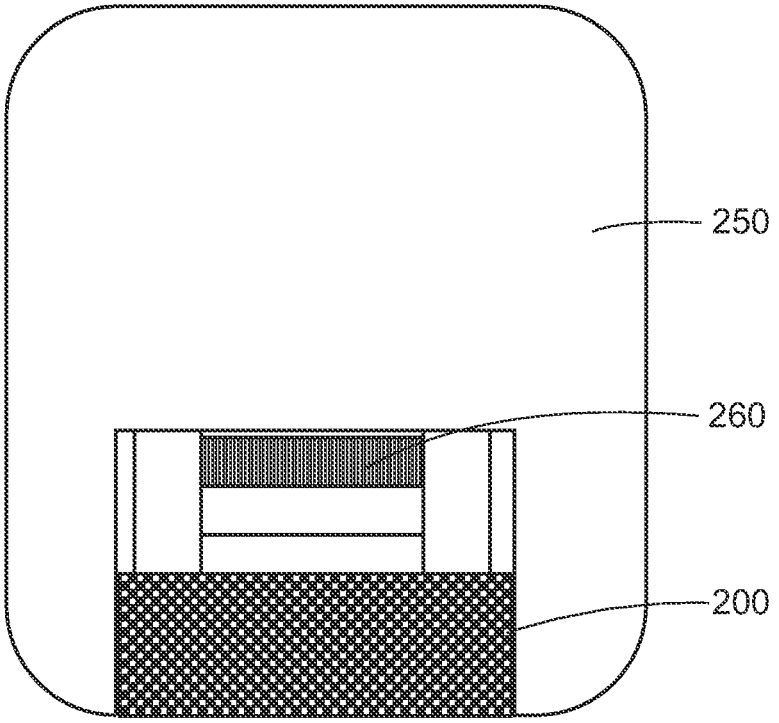
FIG. 2G is a schematic diagram of an example actuator coupling a ballast to an untethered downhole tool.

FIG. 2G depicts an example of the downhole tool 250 coupled to the ballast 200 by the actuator 260 of FIG. 2F. When a pulse of an electrical current (for example, a short, 200-microsecond pulse of an electrical current of about 20 amperes) is applied to the coil 265 in a first direction, the second permanent magnet 261*b* is polarized in the same direction as the first permanent magnet 261*a*, so that magnetic flux lines run through a flux channel 270 to attract the ballast 200 (for example, the magnetic, metallic particles of the first portion 210*a*). The flux channel 270 is made of a material having a high magnetic permeability, such as iron. When an electrical current is applied to the coil 265 in a second direction opposite the first direction, the second permanent magnet 261*b* is polarized in the opposite direction as the first permanent magnet 261*a*, so that the magnetic flux lines run in a loop through the permanent magnets 261*a*, 261*b* but does not substantially extend outward, thereby removing the attractive force to the ballast 200 and decoupling the ballast 200 from the untethered downhole tool 250.

In some implementations, the actuator 260 is an electromagnet including a coil (similar to the coil 265) wrapped around an iron core. The iron core can remain magnetized as long as a current is applied to the coil wrapped around the core. Applying the current through the coil wrapped around the coil can cause the actuator 260 to hold and couple the ballast 200 to the untethered downhole tool 250. Stopping the current from running through the coil de-magnetizes the core. Thus, stopping the current from running through the coil can cause the actuator 260 to release the ballast 200 from the untethered downhole tool 250. However, such implementations are less energy efficient, as they require a constant consumption of energy to keep the ballast 200 held to the untethered downhole tool 250 until the untethered downhole tool 250 has reached a desired location within the well 100.

In some implementations, the actuator 260 includes a permanent magnet and a mechanical actuator, such as a linear actuator. The mechanical actuator can be used to adjust a distance between the permanent magnet and the ballast 200. Adjusting the distance between the permanent magnet and the ballast 200 to be at most a max threshold holding distance can cause the ballast 200 to be held and coupled to the untethered downhole tool 250. Adjusting the distance between the permanent magnet and the ballast 200 to be greater than the max threshold holding distance can cause the ballast 200 to be released from the untethered downhole tool 250.

In some implementations, the actuator 260 couples the ballast 200 to the untethered downhole tool 250 by a mechanical coupling that uses, for example, a pin and loop or a hook. For example, a loop, hook, or cavity can be formed on or coupled (for example, using an adhesive and/or a fastener) to the ballast 200. The actuator 260 can be engaged to such mechanical feature(s) (loop, hook, cavity) to hold and couple the ballast 200 to the untethered downhole tool 250. The actuator 260 can then be disengaged from such mechanical feature(s) to release the ballast 200 from the untethered downhole tool 250. In cases where a pyrotechnic fastener is used, the pyrotechnic fastener can hold and couple the ballast 200 to the untethered downhole tool 250, and the pyrotechnic fastener can break apart to release the ballast 200 from the untethered downhole tool 250.

Figure 2H:
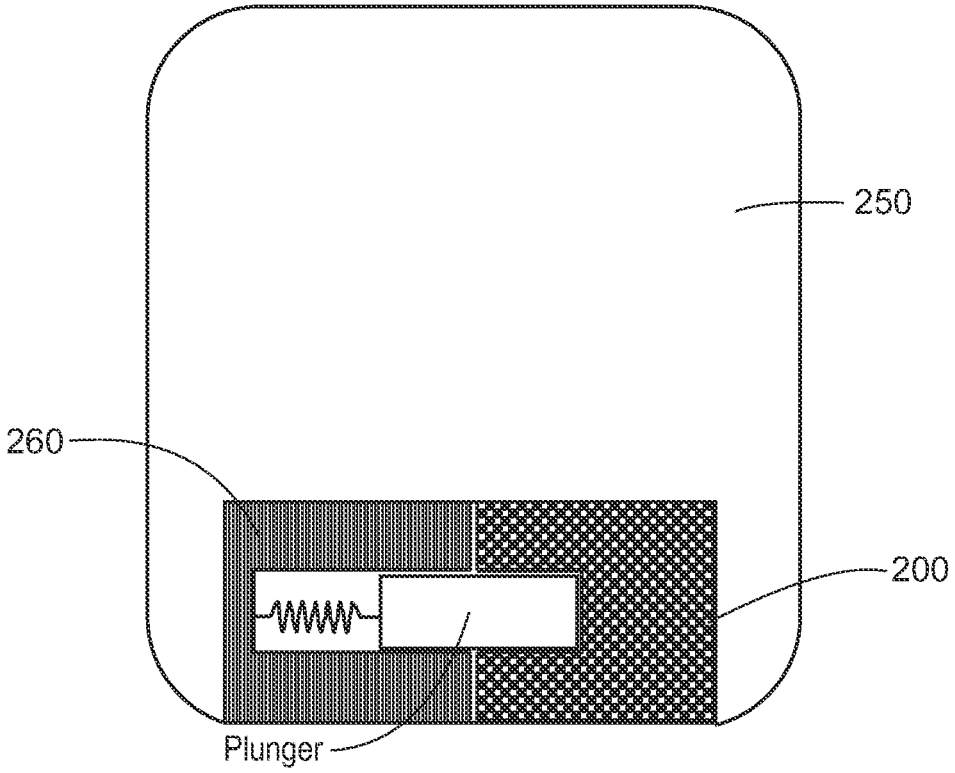
FIG. 2H is a schematic diagram of an example actuator coupling a ballast to an untethered downhole tool.

FIG. 2H depicts an example of the downhole tool 250 coupled to the ballast 200 by an actuator 260'. The actuator 260' is a solenoid actuator. The actuator 260' includes a spring and a plunger configured to latch onto a divot or cavity formed in the ballast 200. The plunger latches onto the divot or cavity formed in the ballast 200 to hold and couple the ballast 200 to the untethered downhole tool 250 as the untethered downhole tool 250 travels downhole in the well 100. Once the untethered downhole tool 250 has reached its desired location within the well 100, the actuator 260' can be activated to detach the plunger from the divot or cavity formed in the ballast 200, thereby releasing the ballast 200 from the untethered downhole tool 250.

Figure 3A:
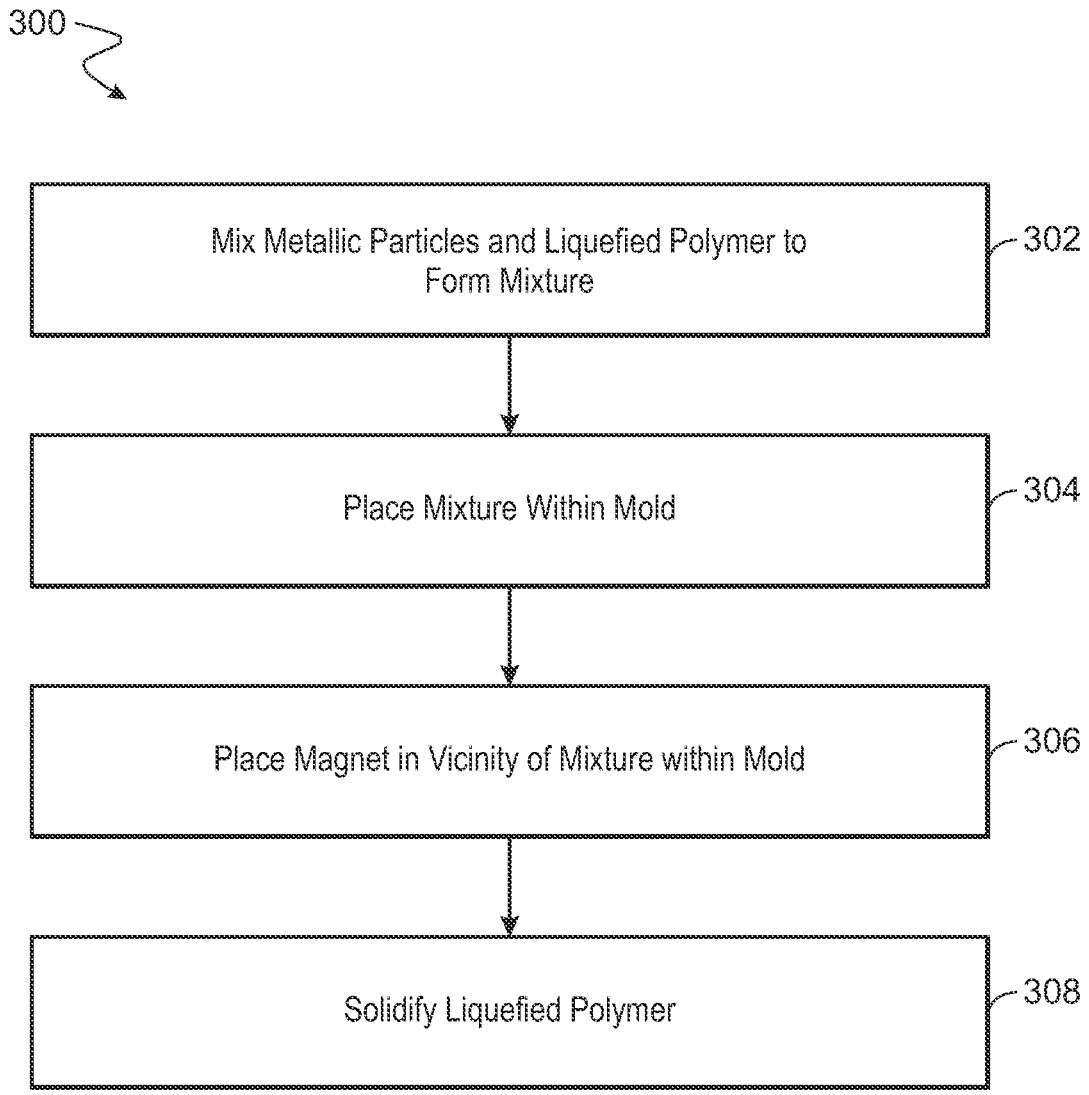
FIG. 3A is a flow chart of an example method for forming a ballast that can be used to lower an untethered downhole tool into a well.
Figure 3B:
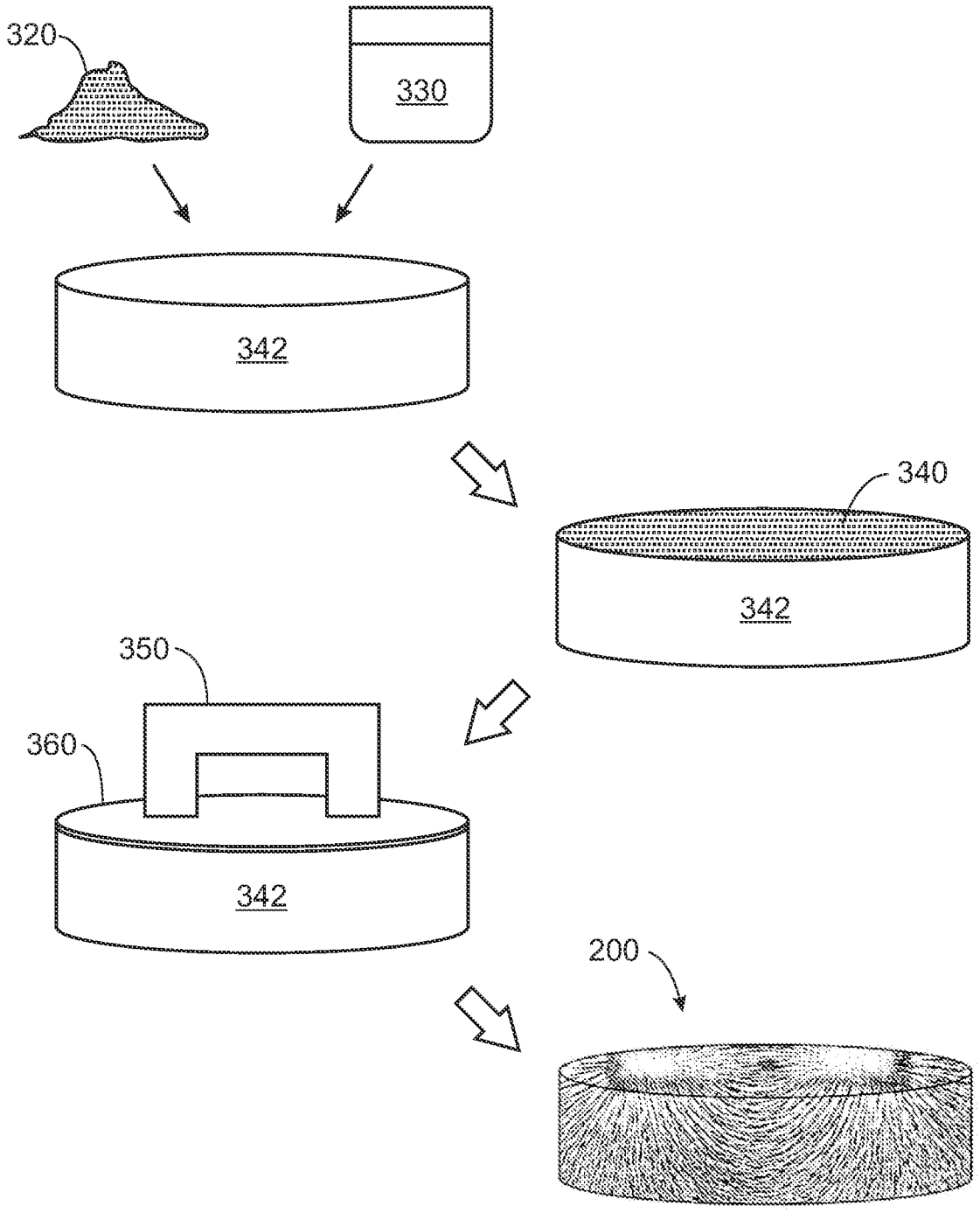
FIG. 3B is a schematic progression of the method whose flow chart is shown in FIG. 3A.

FIG. 3A is a flow chart of an example method 300 for forming the ballast 200. FIG. 3B is an example progression of the method 300. At block 302, metallic particles 320 (such as the metallic particles of the first portion 210*a*) and a liquefied polymer 330 are mixed to form a mixture 340. The metallic particles 320 are magnetic, such that they can attract to an external magnetic field. The liquefied polymer 330 can have a low viscosity, such that the metallic particles 320 can disperse freely in the liquefied polymer 330 once they have been mixed at block 302. For example, the liquefied polymer 330 at block 302 can have a viscosity in a range of from about 1 centipoise (cP) to about 20,000 cP, from about 1 cP to about 10 cP, from about 10 cP to about 100 cP, from about 100 cP to about 1,000 cP, or from about 1,000 cP to about 10,000 cP. At block 304, the mixture 340 formed at block 302 is placed within a mold 342. At block 306, a magnet 350 is placed in the vicinity of the mixture 340 within the mold 342, thereby causing the metallic particles 320 to position themselves in a self-assembly formation within the mixture 340 in response to a magnetic field generated by the magnet 350. For example, the magnet 350 is placed directly against the mixture 340, such that the magnet 350 and the mixture 340 are in contact with each other at block 306. For example, the magnet 350 is placed within 50 μm, within 100 μm, within 500 μm, within 1 mm, within 5 mm, within 1 cm, within 2 cm, within 3 cm, within 4 cm, or within 5 cm from the mixture 340 at block 306. In some implementations, the magnet 350 generates a magnetic field with similar characteristics (for example, size/dimensions and/or magnetic field strength) as a magnetic actuator (such as the actuator 260) that is used to actuate the untethered downhole tool 250 within the well 100. At block 308, the liquefied polymer 330 is solidified, such that a polymer matrix (such as the polymer matrix of the second portion 210*b*) is formed. The metallic particles 320 are distributed and secured in the self-assembly formation throughout the polymer matrix, thereby forming the composite material 210 of the ballast 200 for the untethered downhole tool 250. In some implementations, solidifying the liquefied polymer 330 at block 308 includes cooling the polymer 330 to a temperature that is cooler than a melting point of the polymer 330. In some implementations, solidifying the liquefied polymer 330 includes curing the polymer 330. Curing the polymer 330 can include exposing the polymer 330 to heat or suitable radiation to create cross-linking between polymer chains to produce the polymer matrix of the second portion 210*b*. In some cases, curing the polymer 330 can be promoted by increased pressure and/or including a catalyst, such as a curing agent. After the polymer 330 has solidified, the ballast 200 can be removed from the mold 342. In some cases, the ballast 200 is further processed. For example, the ballast 200 can be machined, such that the ballast 200 has a desired shape. For example, the ballast 200 can be coated by the coating 220. For example, the ballast 200 can be polished, such that the ballast 200 has a desired surface roughness. In some implementations, the ballast 200 is polished, such that the ballast 200 has a surface roughness value in a range of from about 0.1 μm to about 10 μm. Having a low surface roughness can be desirable for the ballast 200, especially at points where a magnetic actuator for the untethered downhole tool 250 comes into contact with the ballast 200 for optimizing magnetic attachment. In some implementations, a separator 360 is placed between the magnet 350 and the mixture 340 before the liquefied polymer 330 is solidified at block 308, such that the magnet 350 does not come into physical contact with the mixture 340. The separator 360 is non-magnetic. For example, the separator 360 can be made of plastic, silicon, aluminum, paper, wood, ceramic, or any combination of these. In some implementations, the separator 360 has a thickness in a range of from about 50 μm to about 1 mm.

Figure 3C:
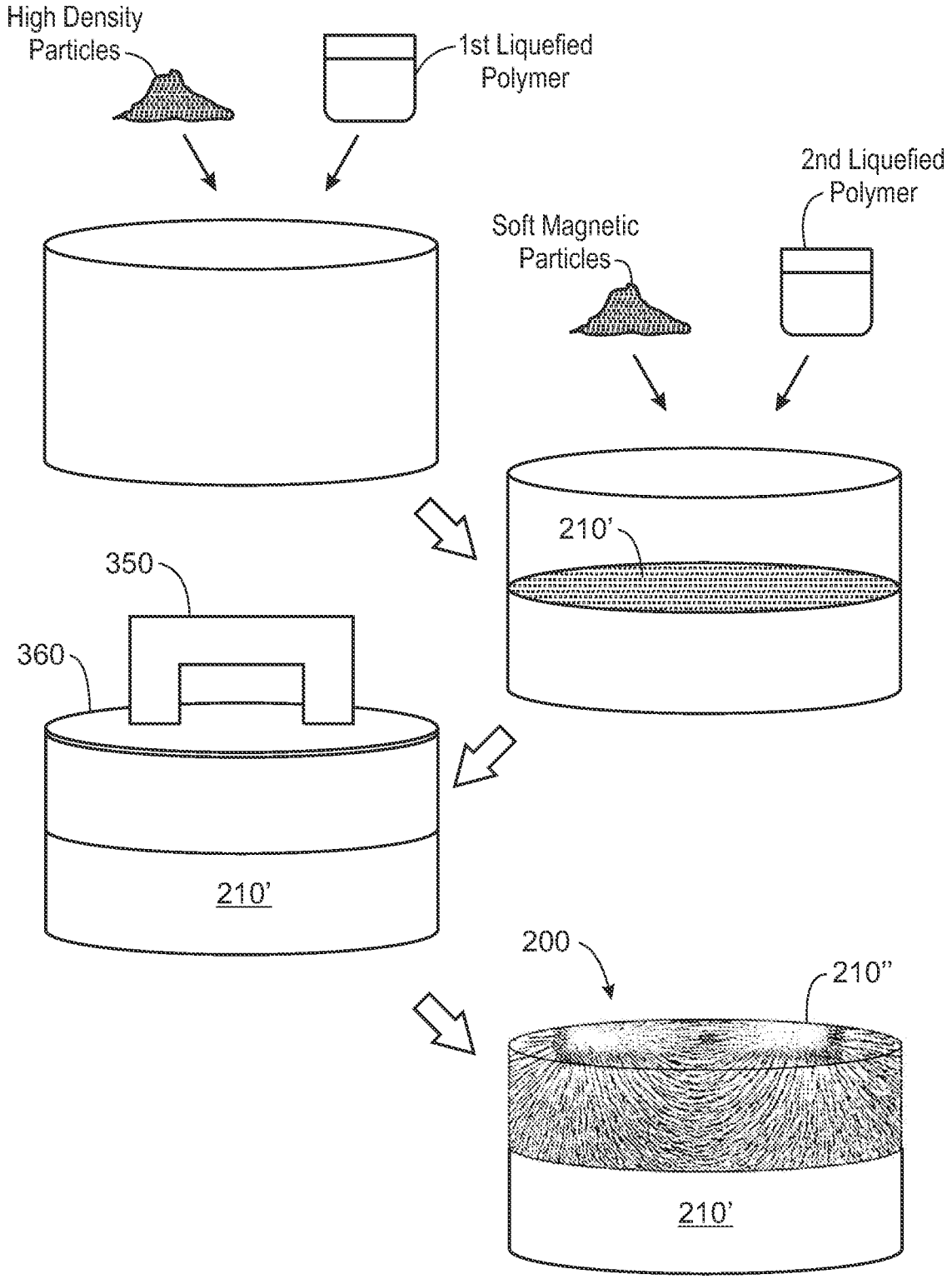
FIG. 3C is a schematic progression of forming a ballast.

FIG. 3C depicts an example progression of forming an implementation of the ballast 200. In some implementations, the ballast 200 includes a first composite material 210' and a second composite material 210". The first composite material 210' can provide the ballast 200 with its weighting function. For example, the first composite material 210' includes high density metallic particles, such as tungsten particles. The second composite material 210" can provide the ballast 200 with soft magnetic properties. For example, the second composite material 210" includes soft ferromagnetic particles, such as iron particles. High density metallic particles and a first liquefied polymer are mixed in a mold to form a first mixture. The first liquefied polymer is solidified, such that a first polymer matrix is formed. The high density metallic particles are distributed throughout the first polymer matrix, thereby forming the first composite material 210'. Soft ferromagnetic particles and a second liquefied polymer are mixed in the mold to form a second mixture. The second mixture is in contact with the first composite material 210'. A magnet (such as the magnet 350) is placed in the vicinity of the second mixture within the mold, thereby causing the soft ferromagnetic particles to position themselves in a self-assembly formation within the second mixture in response to a magnetic field generated by the magnet 350. A separator (such as the separator 360) can be placed between the magnet 350 and the second mixture, such that the magnet 350 does not come into physical contact with the second mixture. The second liquefied polymer is solidified, such that a second polymer matrix is formed. The soft ferromagnetic particles are distributed and secured in the self-assembly formation throughout the second polymer matrix, thereby forming the second composite material 210". In some cases, solidifying the second liquefied polymer causes the second composite material 210" to bond to the first composite material 210', forming the ballast 200. In some cases, the first composite material 210' and the second composite material 210" are coupled together, for example, by an adhesive or by a fastener, to form the ballast 200. Each of the first liquefied polymer and the second liquefied polymer can be implementations of the liquefied polymer 330. In some implementations, the first liquefied polymer and the second liquefied polymer have the same composition. In some implementations, the first liquefied polymer and the second liquefied polymer have different compositions. The size of the first composite material 210' can depend the desired density for the ballast 200. For example, the first composite material 210' can be sized and the relative compositions of the high density metallic particles, soft ferromagnetic particles, first liquefied polymer, and second liquefied polymer can be adjusted to achieve a specified density and/or a specified mass for the ballast 200. In some implementations, the specified density of the ballast 200 is in a range of from about 3 g/cm$^3$ to about 19 g/cm$^3$. In some implementations, the specified mass of the ballast 200 is in a range of from about 10 grams to about 200 grams.

Figure 3D:
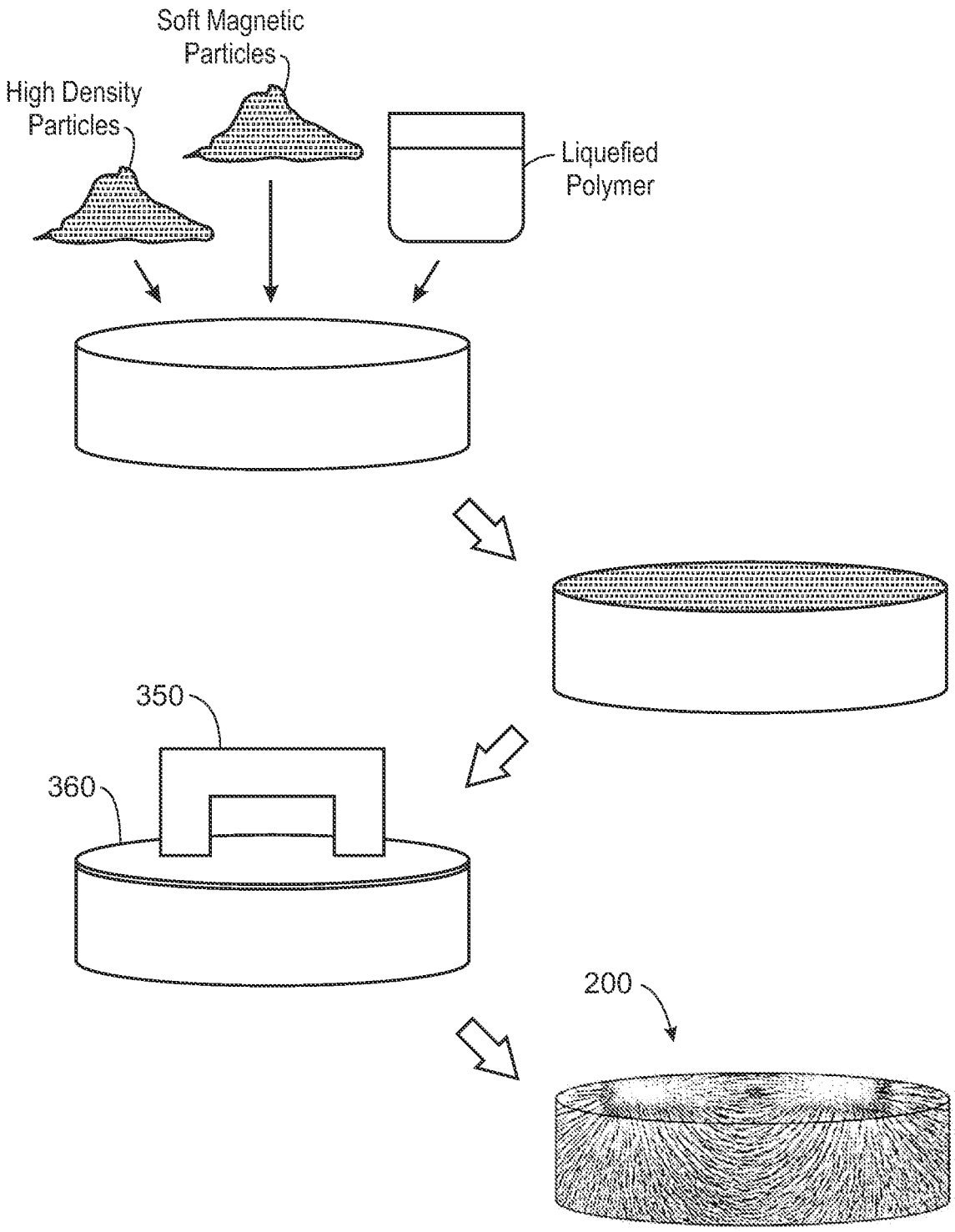
FIG. 3D is a schematic progression of forming a ballast.

FIG. 3D depicts an example progression of forming an implementation of the ballast 200. In some implementations, the composite material 210 includes a first plurality of metallic particles and a second plurality of metallic particles. The first plurality of metallic particles can be high density metallic particles (for example, tungsten particles) that provide the ballast 200 with its weighting function. The second plurality of metallic particles can be soft ferromagnetic particles (for example, iron particles) that provide the ballast 200 with soft magnetic properties. The first plurality of metallic particles, the second plurality of metallic particles, and a liquefied polymer (such as the liquefied polymer 330) are mixed in a mold to form a mixture. A magnet (such as the magnet 350) is placed in the vicinity of the mixture within the mold, thereby causing the second plurality of metallic particles to position themselves in a self-assembly formation within the mixture in response to a magnetic field generated by the magnet 350. A separator (such as the separator 360) can be placed between the magnet 350 and the mixture, such that the magnet 350 does not come into physical contact with the mixture. The liquefied polymer 330 is solidified, such that a polymer matrix is formed. The first plurality of metallic particles are distributed throughout the second polymer matrix, and the second plurality of metallic particles are distributed and secured in the self-assembly formation throughout the polymer matrix, thereby forming the composite material 210 of the ballast 200.

Figure 3E:
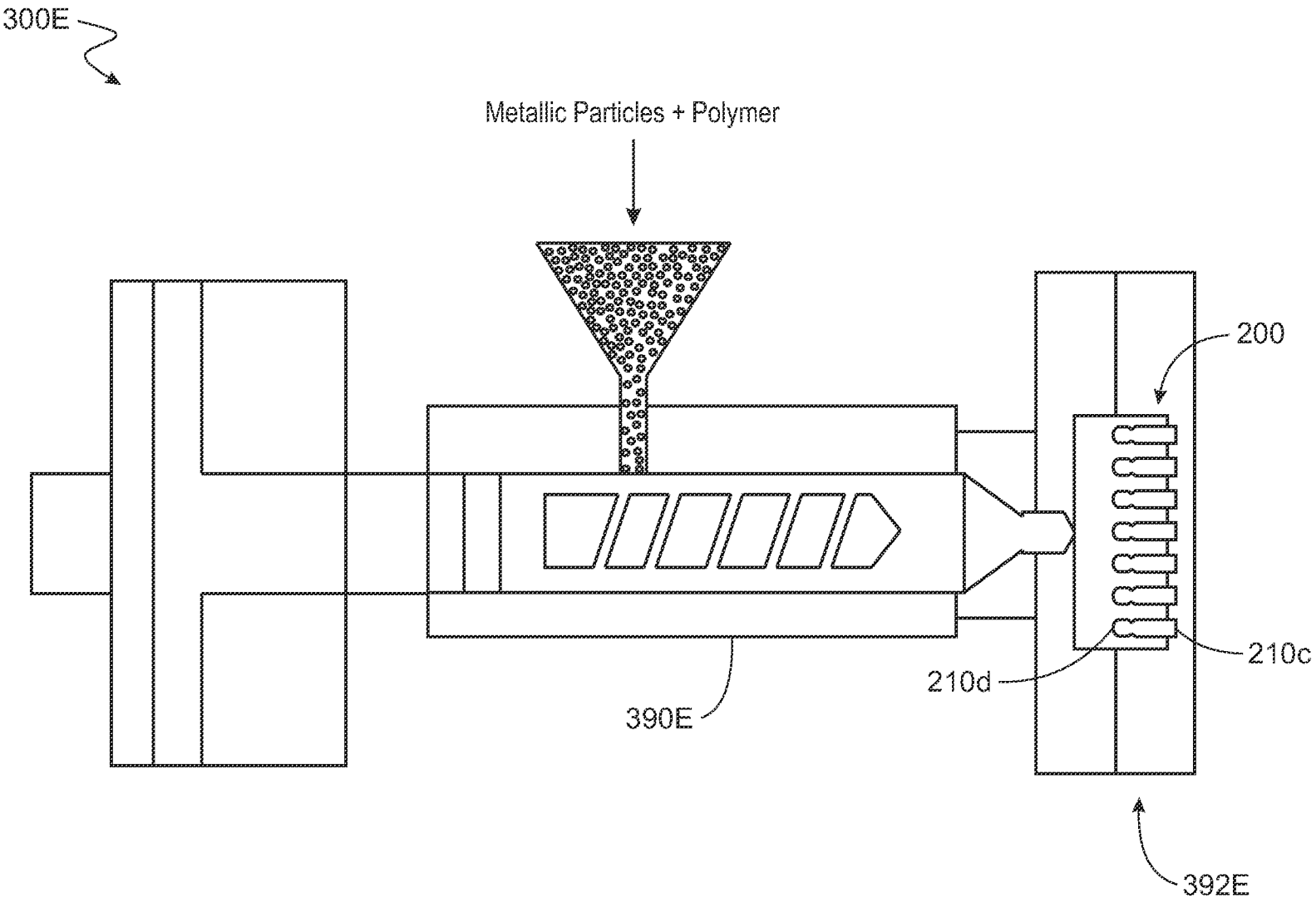
FIG. 3E is a schematic diagram of an insert molding system.

FIG. 3E is a schematic diagram of an insert molding system 300E that can be used to produce the ballast 200. The insert molding system 300E can be used, for example, to produce the example ballasts 200 shown in FIGS. 2C and 2D. The insert molding system 300E includes an extruder 390E and a mold 392E. The metallic particles (first portion 210*a*) and the polymer (second portion 210*b*) are placed into the extruder 390E. In some implementations, an additive (such as a hydrolysis inhibitor) is also placed into the extruder 390E. The extruder 390E melts and blends the mixture to form a molten composite material 210. Soft magnetic inserts (such as the soft magnetic inserts 210*c*) are placed in a mold 392E. In some implementations, the soft magnetic inserts 210*c* include mechanical locks (such as the mechanical locks 210*d*). The extruder 390E pushes the molten composite material 210 into the mold 392E that is already holding the soft magnetic inserts 210*c* (and in some cases, also the mechanical locks 210*d*). The molten composite material 210 fills the mold 392E and surrounds at least a portion of each of the soft magnetic inserts 210*c* (and in some cases, also the mechanical locks 210*d*). The composite material 210 then hardens and/or cures to form the ballast 200. The mechanical locks 210*d* can improve the coupling between the composite material 210 and the soft magnetic inserts 210*c*.

Figure 3F:
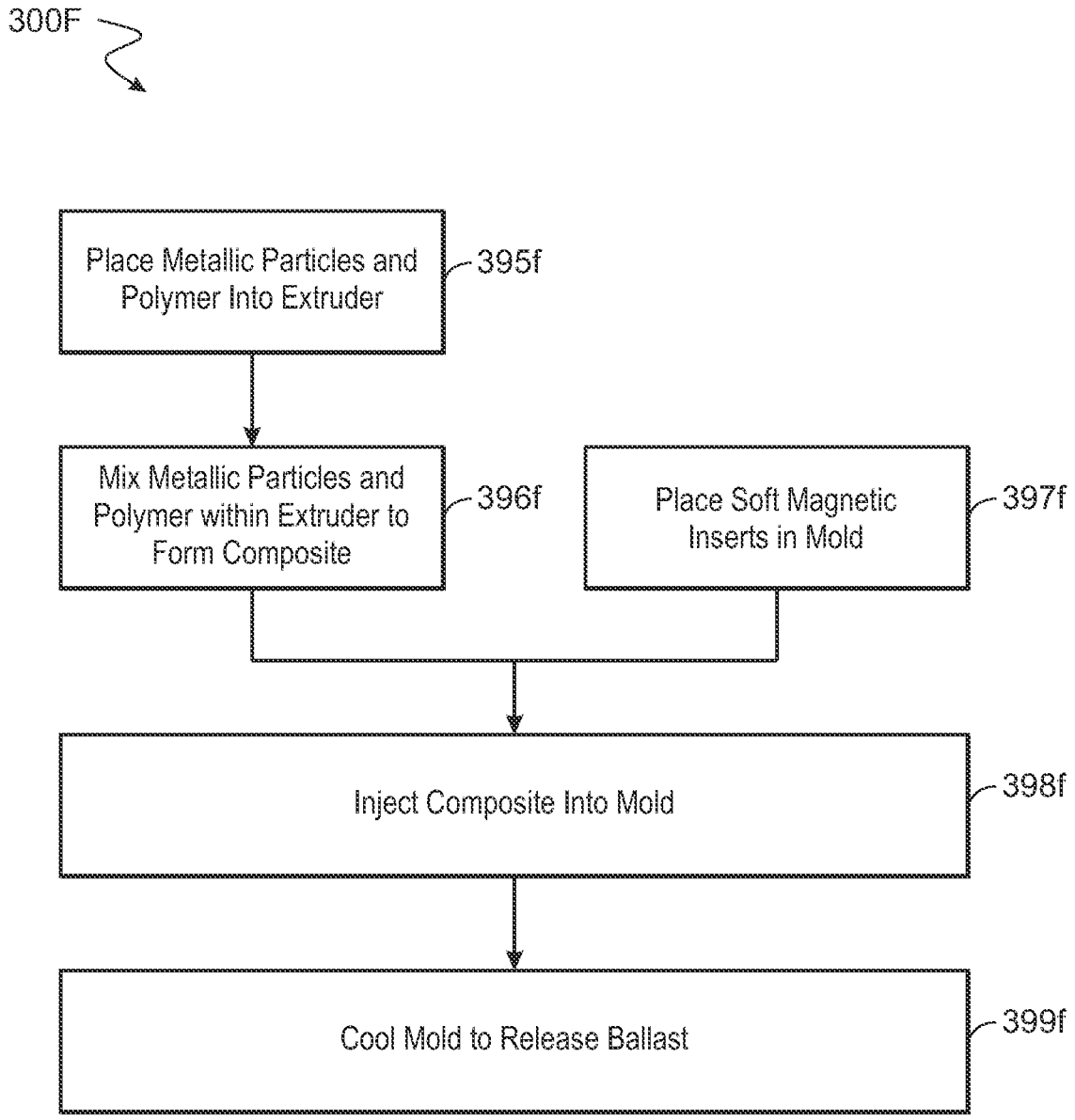
FIG. 3F is a flow chart of the insert molding process.

FIG. 3F is a flow chart of an insert molding process 300F. The insert molding process 300F can, for example, be implemented by the insert molding system 300E. At block 395*f*, metallic particles (first portion 210*a*) and a polymer (second portion 210*b*) are placed into an extruder (such as the extruder 390E). In some implementations, an additive (such as a hydrolysis inhibitor) is also placed into the extruder 390E at block 395*f* At block 396*f*, the polymer is liquefied (for example, melted) and mixed with the metallic particles within the extruder 390E to form a molten composite material 210. In cases where an additive is included, the additive is also mixed with the polymer and the metallic particles at block 396*f*. At block 397*f*, soft magnetic inserts (such as the soft magnetic inserts 210*c*) are placed in a mold (such as the mold 392E. In some implementations, the soft magnetic inserts 210*c* include mechanical locks (such as the mechanical locks 210*d*). In such implementations, the mechanical locks 210*d* are also placed in the mold 392E at block 397*f* At block 398*f*, the molten composite material 210 is extruded by the extruder 390E and injected into the mold 392E which contains the soft magnetic inserts 210*c* (and in some cases, also the mechanical locks 210*d*). The molten composite material 210 is solidified to form the ballast 200. In some implementations, solidifying the molten composite material 210 includes hardening and/or curing the liquefied polymer to form a hardened polymer matrix. Solidifying the composite material 210 couples the soft magnetic inserts 210*c* (and in some cases, also the mechanical locks 210*d*) to the composite material 210. At block 399*f*, the mold 392E is cooled to release the formed ballast 200 from the mold 392E.

Figure 3G:
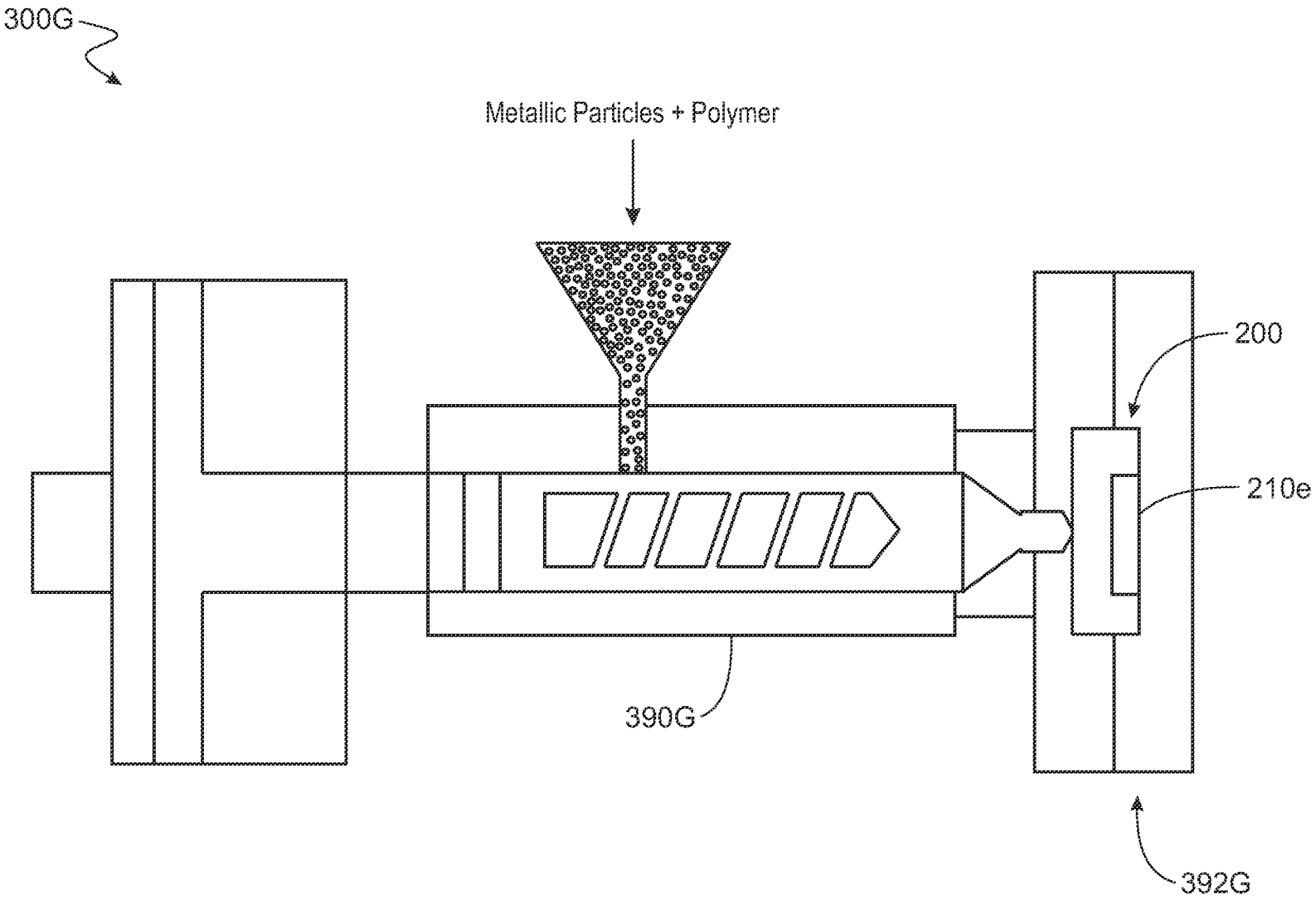
FIG. 3G is a schematic of an over-molding system.

FIG. 3G is a schematic of an over-molding system 300G that can be used to produce the ballast 200. The over-molding system 300G can be used, for example, to produce the example ballast 200 shown in FIG. 2E. The over-molding system 300G includes an extruder 390G and a mold 392G. The extruder 390G can be substantially similar to the extruder 390E of the insert molding system 300E. The mold 392G can be substantially similar to the mold 392E of the insert molding system 300E. The metallic particles (first portion 210*a*) and the polymer (second portion 210*b*) are placed into the extruder 390G. In some implementations, an additive (such as a hydrolysis inhibitor) is also placed into the extruder 390G. The extruder 390G melts and blends the mixture to form a molten composite material 210. A soft magnetic attachment plate (such as the attachment plate 210*e*) is placed in a mold 392G. In some implementations, the attachment plate 210*e* includes a mechanical lock (similar to the mechanical lock 210*d*). The extruder 390G pushes the molten composite material 210 into the mold 392G that is already holding the attachment plate 210*e* (and in some cases, an implementation of the mechanical lock 210*d*). The molten composite material 210 fills the mold 392G and surrounds at least a portion of the attachment plate 210*e* (and in some cases, also the mechanical lock 210*d*). The composite material 210 then hardens and/or cures to form the ballast 200. The mechanical lock 210*d* can improve the coupling between the composite material 210 and the attachment plate 210*e*.

Figure 3H:
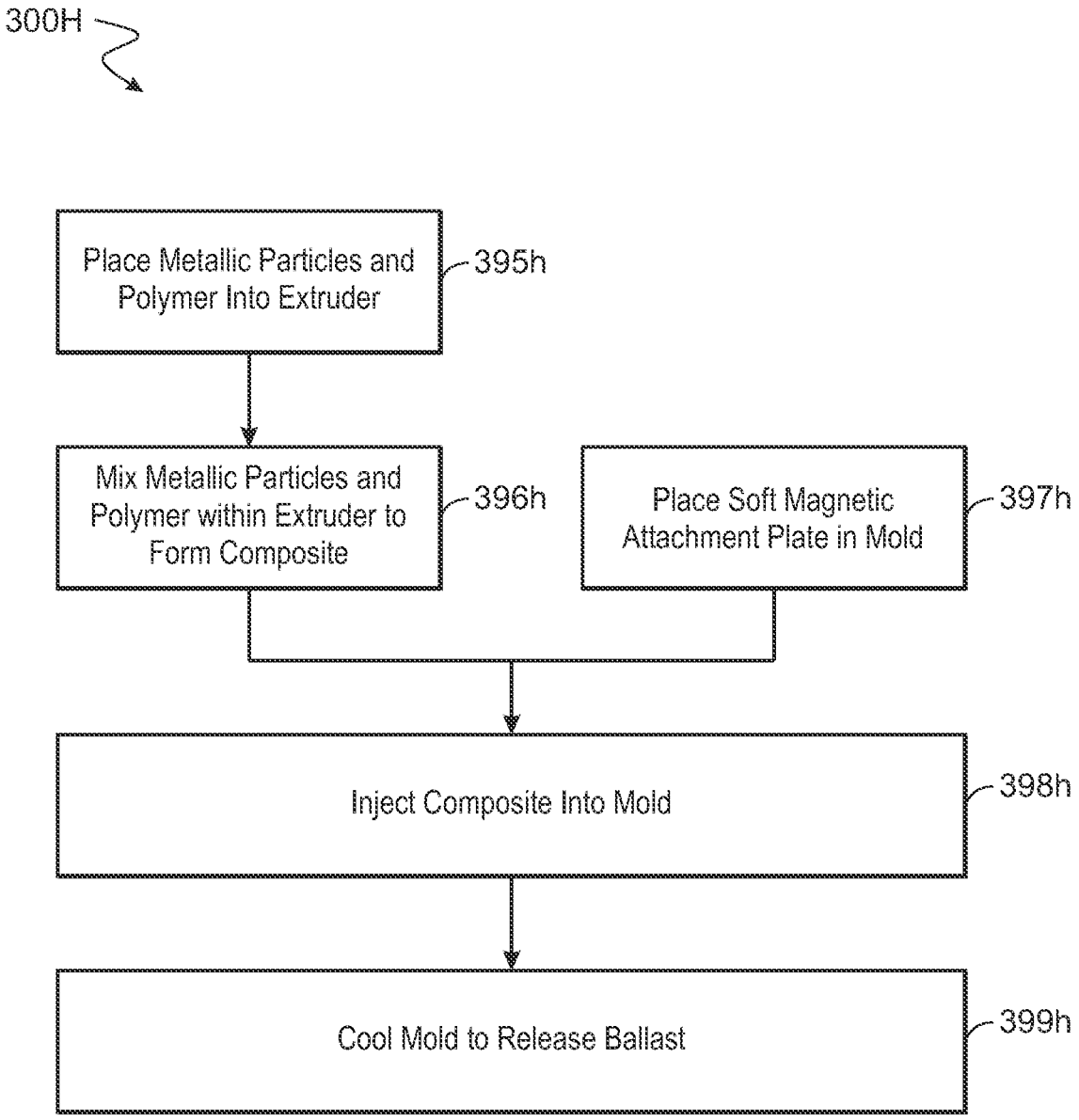
FIG. 3H is a flow chart of the over-molding process.

FIG. 3H is a flow chart of an over-molding process 300H. The over-molding process 300H can, for example, be implemented by the over-molding system 300G. At block 395*h*, metallic particles (first portion 210*a*) and a polymer (second portion 210*b*) are placed into an extruder (such as the extruder 390G). In some implementations, an additive (such as a hydrolysis inhibitor) is also placed into the extruder 390G at block 395*h*. At block 396*h*, the polymer is liquefied (for example, melted) and mixed with the metallic particles within the extruder 390G to form a molten composite material 210. In cases where an additive is included, the additive is also mixed with the polymer and the metallic particles at block 396*h*. At block 397*h*, a soft magnetic attachment plate (such as the attachment plate 210*e*) is placed in a mold (such as the mold 392G. In some implementations, the attachment plate 210*e* includes a mechanical lock (such as the mechanical lock 210*d*). In such implementations, the mechanical lock 210*d* are also placed in the mold 392G at block 397*h*. At block 398*h*, the molten composite material 210 is extruded by the extruder 390G and injected into the mold 392G which contains the attachment plate 210*e* (and in some cases, also the mechanical lock 210*d*). The molten composite material 210 is solidified to form the ballast 200. In some implementations, solidifying the molten composite material 210 includes hardening and/or curing the liquefied polymer to form a hardened polymer matrix. Solidifying the composite material 210 couples the attachment plate 210*e* (and in some cases, also the mechanical lock 210*d*) to the composite material 210. At block 399*h*, the mold 392G is cooled to release the formed ballast 200 from the mold 392G.

Figure 4A:
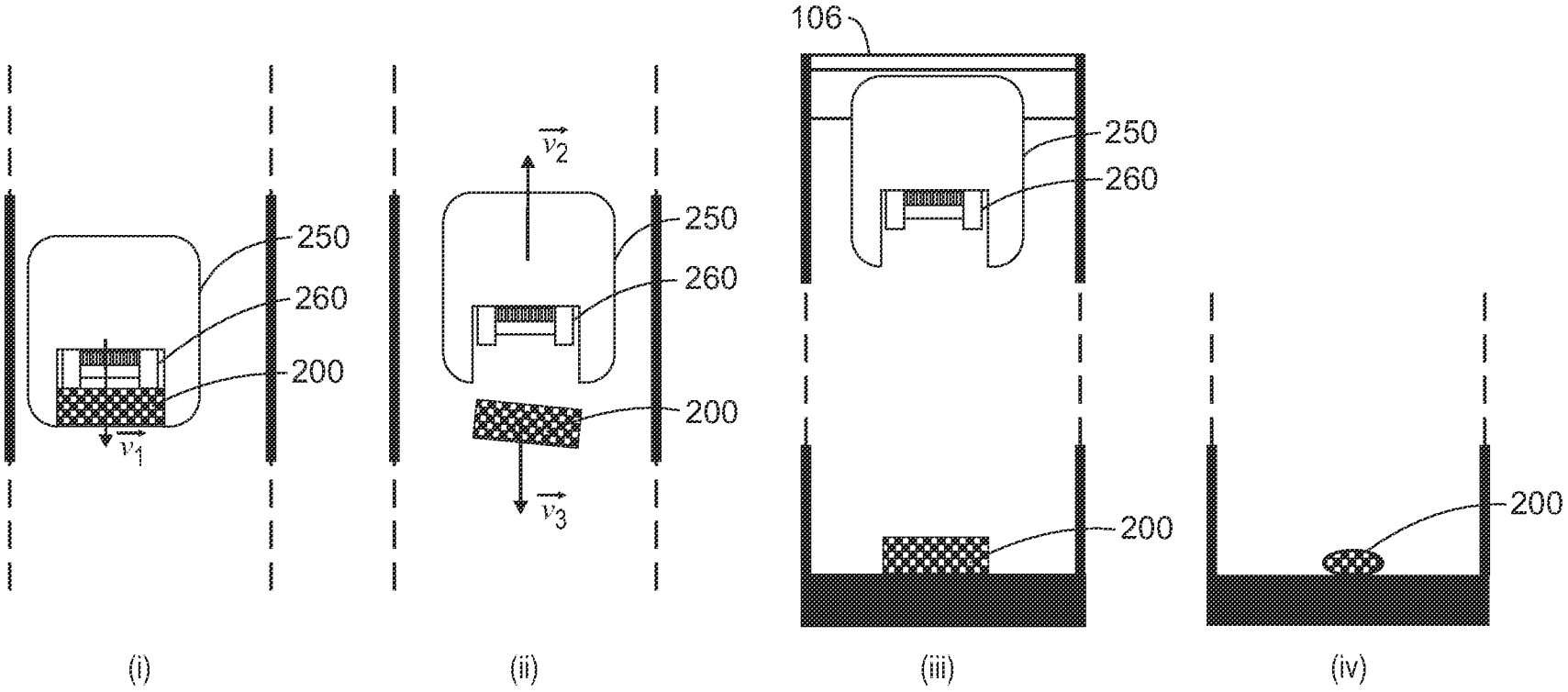
FIG. 4A is a schematic progression of deploying an untethered downhole tool coupled to a ballast in a well.

FIG. 4A depicts an example progression of deploying the untethered downhole tool 250 coupled to the ballast 200 by the actuator 260 in the well 100. At (i), the untethered downhole tool 250 travels downhole within the well 100 at a first velocity ($v_1$). At (ii), after the untethered downhole tool 250 has reached a desired location within the well 100, the actuator 260 disengages from the ballast 200, such that the ballast 200 releases from the untethered downhole tool 250, resulting in the untethered downhole tool 250 regaining buoyancy. The untethered downhole tool 250 travels back uphole at a second velocity ($v_2$), and the ballast 200 continues to travel downhole at a third velocity ($v_3$). Eventually at (iii), the untethered downhole tool 250 returns to the surface 106, and the ballast 200 rests at or near a bottom of the well 100. As time passes (iv), the ballast 200 dissolves, and the weighting materials (for example, the high density metallic particles and/or the soft magnetic particles) are released to the downhole fluid in the well 100.

Figure 4B:
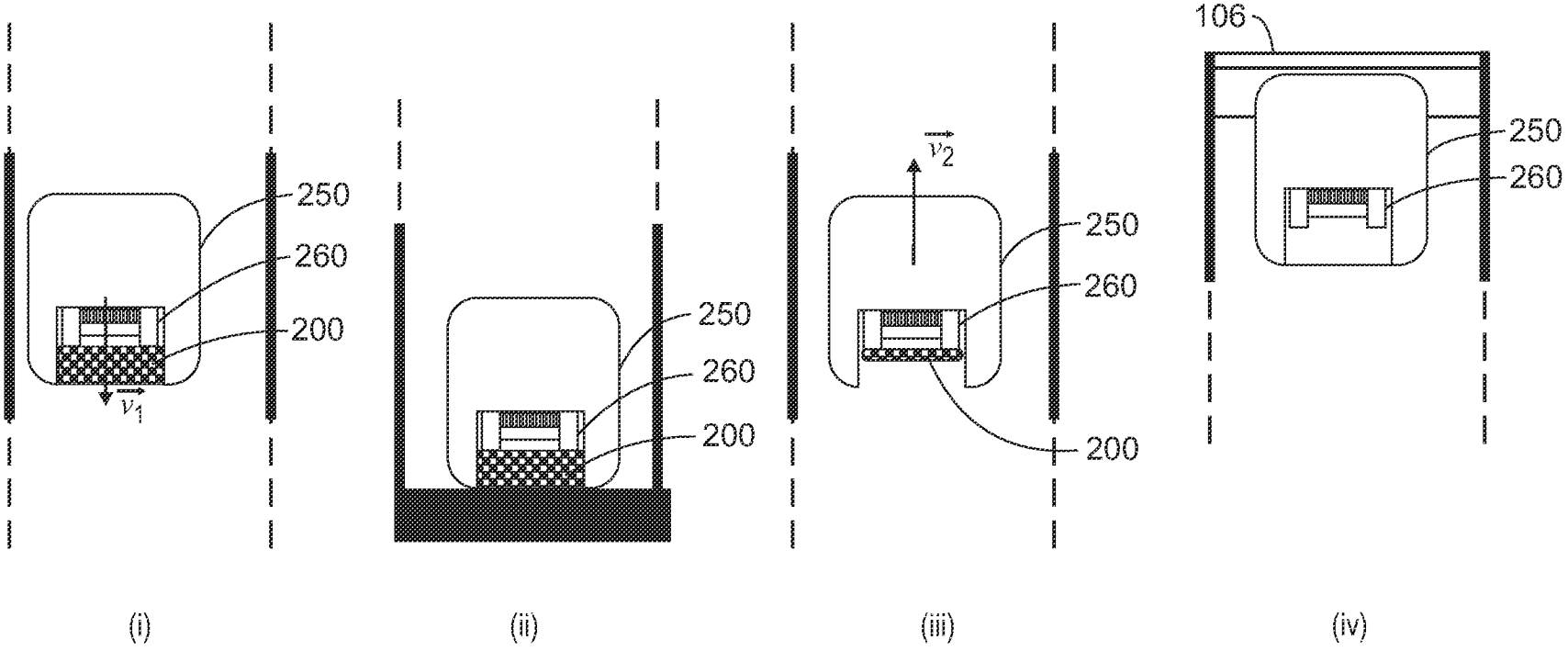
FIG. 4B is a schematic progression of deploying an untethered downhole tool coupled to a ballast in a well.

FIG. 4B depicts an example progression of deploying the untethered downhole tool 250 coupled to the ballast 200 by the actuator 260 in the well 100. At (i), the untethered downhole tool 250 travels downhole within the well 100 at a first velocity ($v_1$). In this case, for whatever reason, the actuator 260 does not disengage from the ballast 200 (for example, due to actuator failure). At (ii), the untethered downhole tool has reached a bottom of the well 100. As time passes (iii), the ballast 200 dissolves, and the weighting materials (for example, the high density metallic particles and/or the soft magnetic particles) are released to the downhole fluid in the well 100. As the ballast 200 dissolves, the untethered downhole tool 250 begins to regain buoyancy and travels back to the surface 106 at a second velocity ($v_2$). At (iv), the ballast 200 has fully dissolved, and the untethered downhole tool 250 has returned to the surface 106.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

As used in this disclosure, the term "metallic" is used to include metallic element(s), any alloy including metallic element(s), any oxide including metallic element(s), and any ceramic including metallic element(s).

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. An apparatus comprising:

an untethered downhole tool; and a ballast configured to couple to the untethered downhole tool and, while the ballast is coupled to the downhole tool, move the untethered downhole tool lower in a well in a subterranean formation filled with a downhole fluid, the ballast comprising a composite material comprising:

a first portion comprising ferromagnetic particles; and a second portion comprising a polymer matrix, the ferromagnetic particles of the first portion distributed throughout the polymer matrix of the second portion; and a magnetic actuator coupled to the untethered downhole tool, the magnetic actuator comprising:

a first permanent magnet;

a second permanent magnet;

a coil wrapped around the second permanent magnet, the coil configured to apply a first current in a first direction, the coil configured to apply a second current in a second direction opposite the first direction, wherein:

while the coil applies the first current in the first direction, the first permanent magnet and the second permanent magnet are configured to be magnetically polarized in the same direction, thereby generating an attractive force on the ferromagnetic particles of the first portion and coupling the ballast to the untethered downhole tool; and while the coil applies the second current in the second direction, the first permanent magnet and the second permanent magnet are configured to be magnetically polarized in opposite directions, thereby removing the attractive force on the ferromagnetic particles of the first portion and decoupling the ballast from the untethered downhole tool.

2. The apparatus of claim 1, wherein the composite material has a density that is sufficient to cause the untethered downhole tool when coupled to the ballast to continue to travel downhole in the well until the untethered downhole tool coupled to the ballast reaches a specified downhole location in the well.

3. The apparatus of claim 2, wherein the polymer matrix of the second portion is configured to dissolve in response to being exposed to the downhole fluid within the well at specified downhole conditions, and is configured to begin dissolving in response to being exposed to downhole fluid within the well at a downhole temperature in a range of from about 4 degrees Celsius (° C.) to about 200° C.

4. The apparatus of claim 3, wherein the polymer matrix of the second portion is configured to begin dissolving in response to being exposed to downhole fluid within the well at a first dissolution rate sufficient for the ballast to provide weight to the untethered downhole tool, when the ballast is coupled to the downhole tool, as the untethered downhole tool travels downhole in the well toward the specified downhole location, and the polymer matrix of the second portion is configured to dissolve in response to being exposed to downhole fluid within the well at a second dissolution rate sufficient for the polymer matrix of the second portion to fully dissolve at the specified downhole conditions once the untethered downhole tool has reached the specified downhole location in the well.

5. The apparatus of claim 4, wherein the composite material comprises about 70% to about 99% by weight of the first portion.

6. The apparatus of claim 5, wherein the polymer matrix is water-dissolvable and comprises at least one of polylactic acid (PLA), polyvinyl alcohol (PVA), polyglycolide (PGA), starch, cellulose, lipids, collagen, or chitin.

7. The apparatus of claim 5, wherein the ballast comprises a coating that covers at least a portion of an external surface of the composite material, thereby at least partially obstructing exposure of the polymer matrix of the second portion to downhole fluid and slowing down the dissolution of the polymer matrix of the second portion.

8. The apparatus of claim 7, wherein the coating has a thickness in a range of from about 1 micrometer (μm) to about 100 μm.

9. The apparatus of claim 8, wherein the coating comprises at least one of polytetrafluoroethylene (PTFE), parylene, diamond, silicon nitride, or silicon carbide.

10. The apparatus of claim 1, wherein the ferromagnetic particles have an average particle diameter in a range of from about 10 micrometers (μm) to about 1 millimeter (mm).

11. The apparatus of claim 1, wherein the ferromagnetic particles comprise particles of at least one of tungsten, copper, iron, steel, nickel, cobalt, iron oxide, ferrite, silicon, tantalum, molybdenum, or lead.

12. The apparatus of claim 1, wherein the ferromagnetic particles are configured to provide soft magnetic properties to the ballast, and the ferromagnetic particles have a relative magnetic permeability greater than 10 and a non-zero magnetic coercivity that is less than 1 kiloamperes per meter (kA/m).

13. A system comprising:

an untethered tool configured to perform an operation within a well without being tethered to a surface of the well; and a ballast configured to:

couple to the untethered tool;

when attached to the untethered tool, provide negative buoyancy in a fluid within the well to a combination of the untethered tool and the ballast, and wherein the ballast comprises a composite material comprising:

a first portion comprising ferromagnetic particles; and a second portion comprising a polymer matrix, the ferromagnetic particles of the first portion distributed throughout the polymer matrix of the second portion; and a magnetic actuator coupled to the untethered tool, the magnetic actuator comprising:

a first permanent magnet;

a second permanent magnet;

a coil wrapped around the second permanent magnet, the coil configured to apply a first current in a first direction, the coil configured to apply a second current in a second direction opposite the first direction, wherein:

while the coil applies the first current in the first direction, the first permanent magnet and the second permanent magnet are configured to be magnetically polarized in the same direction, thereby generating an attractive force on the ferromagnetic particles of the first portion and coupling the ballast to the untethered tool; and while the coil applies the second current in the second direction, the first permanent magnet and the second permanent magnet are configured to be magnetically polarized in opposite directions, thereby removing the attractive force on the ferromagnetic particles of the first portion and decoupling the ballast from the untethered tool.

14. The system of claim 13, wherein the composite material comprises about 70% to about 99% by weight of the first portion.

15. The system of claim 13, wherein the metallic particles comprise particles of at least one of tungsten, copper, iron, steel, nickel, cobalt, iron oxide, ferrite, silicon, tantalum, molybdenum, or lead.

16. The system of claim 13, wherein the polymer matrix is water-dissolvable and comprises at least one of polylactic acid (PLA), polyvinyl alcohol (PVA), polyglycolide (PGA), starch, cellulose, lipids, collagen, or chitin.

17. The system of claim 13, wherein the second portion configured to dissolve in response to being exposed to the fluid within the well at specified downhole conditions.

18. The system of claim 17, wherein the polymer matrix of the second portion is configured to begin dissolving in response to being exposed to the fluid within the well at a downhole temperature in a range of from about 4 degrees Celsius (° C.) to about 200° C.

19. The system of claim 17, wherein the polymer matrix of the second portion is configured to begin dissolving in response to being exposed to the fluid within the well at a first dissolution rate sufficient for the ballast to provide weight to the untethered tool, when the ballast is coupled to the untethered tool, as the untethered tool travels downhole in the well toward the specified downhole location, and the polymer matrix of the second portion is configured to dissolve in response to being exposed to the fluid within the well at a second dissolution rate sufficient for the polymer matrix of the second portion to fully dissolve at the specified downhole conditions once the untethered tool has reached the specified downhole location in the well.

* * * * *